United States Patent [19]

Romney

[11] 4,179,688

[45] Dec. 18, 1979

[54] INFORMATION DISPLAY SYSTEM

[76] Inventor: Russell H. Romney, 3259 Bon View Dr., Salt Lake City, Utah 84109

[21] Appl. No.: 763,914

[22] Filed: Jan. 31, 1977

[51] Int. Cl.[2] ..... G08B 5/00

[52] U.S. Cl. ..... 340/373; 340/381

[58] Field of Search ..... 340/381, 373, 336; 250/553

[56] References Cited

U.S. PATENT DOCUMENTS

| | | | |
|---|---|---|---|
| 3,582,927 | 6/1971 | Primavera | 340/225 |
| 3,636,558 | 1/1972 | Debaight | 340/381 |
| 3,681,552 | 8/1972 | Bailey | 340/381 |
| 3,685,049 | 8/1972 | Immel | 340/381 |
| 3,742,446 | 8/1971 | Wells | 340/381 |
| 3,754,244 | 8/1973 | Garret | 340/381 |
| 3,932,862 | 1/1976 | Graven | 250/553 |
| 3,970,990 | 7/1976 | Carson | 250/553 |

*Primary Examiner*—Harold I. Pitts

[57] ABSTRACT

A large display sign, or analogous visual or radiant energy display or collecting surface area, is made up of numerous frontal individual "radiation sensitive" display elements arranged contiguously but in module groups, covering the full display area without gaps. The module unit occupying each such square is supported on a "tile" or equivalent base. Each base supports through bifurcate hinged connector (BHC) means an insulated multiple conductor power buss, a module area portion of a first or rear most circuit board or panel, and a group of insulating penetrating contacts with attached wires supported by this BHC between the base and the rear panel. At eight, symmetrically arranged around its center, each module comprises a BHC for each point and multiple contacts around each BHC, some connected to the penetrating contact wires. A second panel bears rearwardly and forwardly extending contact pins for electric contact with the rear and with a front panel. Supplemental electronic means which participate in the controlling function are mounted on the intermediate panel.

18 Claims, 42 Drawing Figures

174
172
176
175
187
187
280
267
280
271
271

261
262
180
263
260
275
275
600
267
271
280
266
275
270
272
268
281

275
269
273
16
274
16
271
267
280
275
273
272
274

POWER CIRCUIT

MODULE ENABLE MATRIX

ELEMENT SELECTOR MATRIX

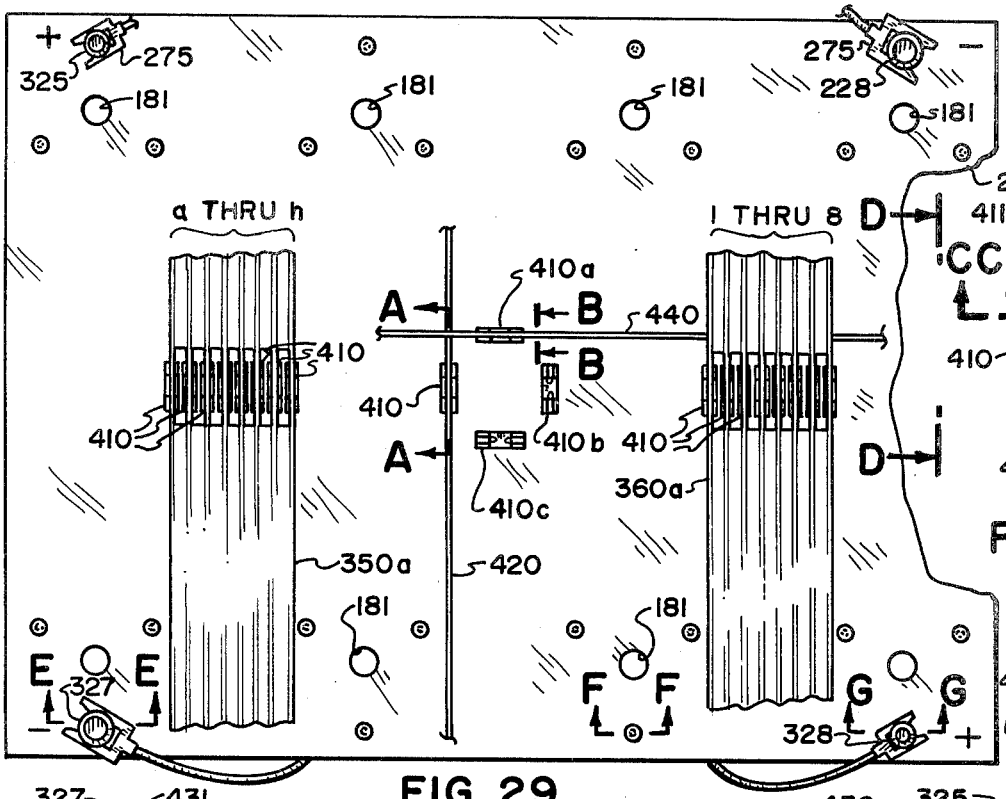
FIG. 29
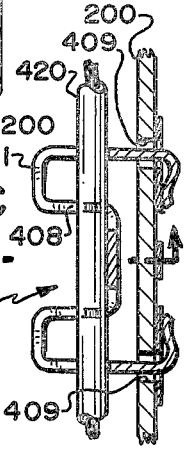
FIG. AA
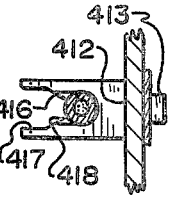
FIG. BB
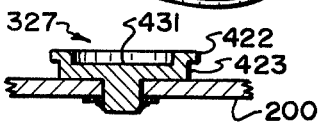
FIG. EE
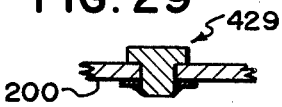
FIG. FF
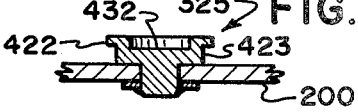
FIG. GG
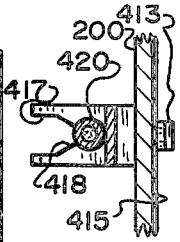
FIG. CC
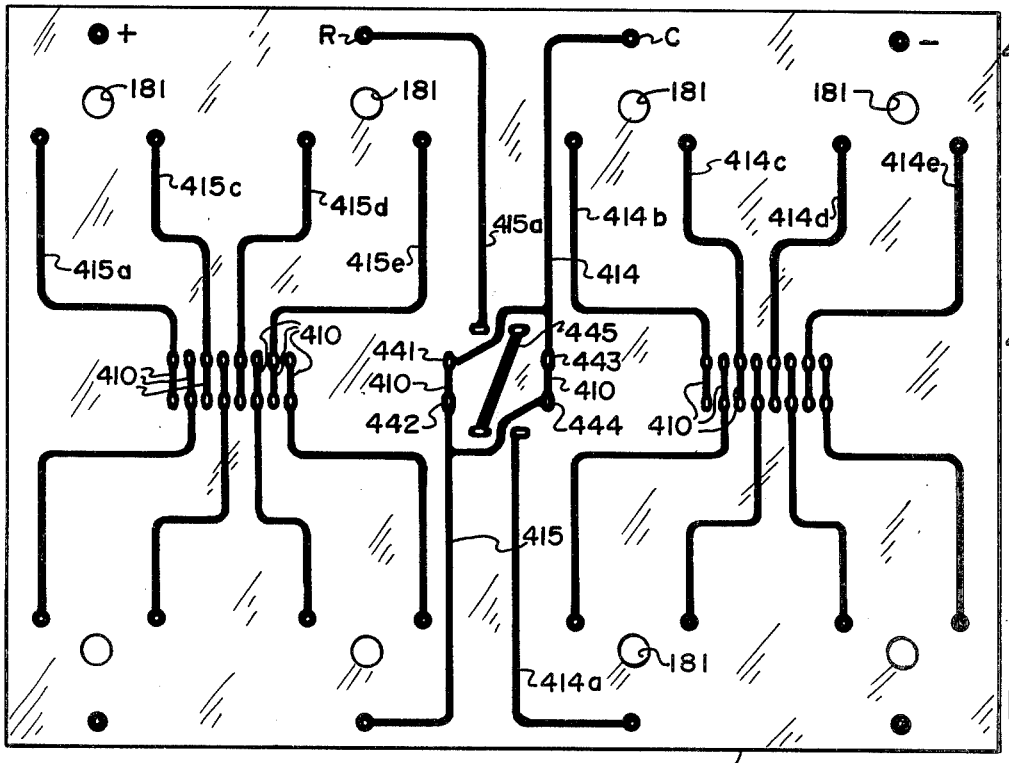
FIG. 30
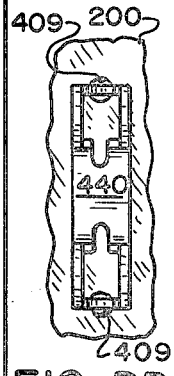
FIG. DD

CONTROLLER "A"

INFORMATION DISPLAY SYSTEM

BACKGROUND AND PRIOR ART

The present invention relates in a specific embodiment to an improved information display system but it will be understood that in at least certain of its aspects it has broader applications. One of these is an arrangement or application for collecting energy, rather than distributing it, e.g., as in collecting electrical energy derived from solar or other thermal sources, and conveying it to systems which store, distribute or otherwise make use of the collected energy. The present description, however, will proceed as being largely applicable to changeable signs and analogous display systems for giving information to the public and related uses.

It has been a custom of the past to make up signs and other display apparatus of multiple components, elements or modules, arranged in groups and selectively lighted or otherwise activated to provide useful information to the public or to concerned groups or individuals. Often, individual modules are made up of multiple elements which can be selectively lighted or energized to produce intelligible characters, such as letters of the alphabet or numerical symbols, etc. Groups of such modules have been arranged so as to make up complete sentences or groups of symbols, and these have been variously arranged in rows and columns to provide relatively large display areas. The individual elements making up a module may be electrically lighted with incandescent or other lamps, or they may have dark and light surfaces which can be moved selectively to display the desired character, symbol, etc. One example of such an arrangement is shown and described in applicant's prior U.S. Pat. No. 4,006,476, based on application Ser. No. 576,127, filed May 9, 1975. Other general examples may be found in references noted in said patent. More specifically, in another prior application filed by the present inventor, Ser. No. 628,756, on Nov. 4, 1975, of which the present application is a continuation-in-part there is disclosed a system including elements making up modules and modules arranged in groups which includes specific disclosure forming a part of the present application.

Hence, the present application contains some of the components and elements disclosed and, in some instances, claimed in the parent application Ser. No. 628,756 and further reference will be made herein to said parent application.

One of the problems associated with multiple element, multiple module display signs and analogous apparatus is that the components become exceedingly numerous and their interconnection becomes so complex that they are very expensive to build. Also, because of the extensive wiring involved, and the necessity of activating so many small components, they tend to use large amounts of power. They also involve, frequently, extensive and expensive switching or commutating mechanisms, including multiple relays, etc., which further increases costs of manufacture and operation. An important object of the present invention relates to means and methods of minimizing such complexities and costs.

Thus, the present invention relates to a system or systems, and to a method or methods, for transferring power from one plane or "level" to another by relatively simple connection and support structure involving far fewer components than prior art displays of comparable capacity. These results are obtained by use of multiple but identical and interchangeable module bases, referred to herein as "tiles" for convenience. These tiles are made up by injection molding of deformed plates of plastic resilient material of relatively very light weight, but still having good structural strength. Some of the components are mounted directly on these tiles, or secured to other parts, by use of plastic, elastic fasteners of the bifurcate hinged type described and claimed in U.S. Pat. No. 3,633,250, issued Jan. 11, 1972, to the present inventor. These will be referred to herein as "BHC" devices, for brevity.

For transmitting electrical energy, whether to distribute it to sign elements or to collect it from solar cells or other energy transforming elements, use is made in the present invention of multiple surfaces or planes. Each of these planes may be represented by a physical element, such as a wall, board or panel, or by a group of contiguously arranged panels, bases or "tiles", as mentioned above, lying more or less in a common plane or common surface (which may be other than planar, such as cylindrical, spherical, etc.,) interconnected with other planes or surface elements arranged parallel to the first mentioned, but spaced therefrom, by inexpensive and interchangeable fasteners or spacers, etc.

Beginning at the base or rearmost support plane or surface, this may be composed of adjacent module bases or "tiles" fixed to a wall, or to a framework having continuous or discontinuous elements lying in a common plane or surface, to which a next succeeding or adjacent second surface element, such as a printed wiring board or panel, or the like, is connected and supported. This second succeeding plane or surface may comprise a first printed wiring board which, in turn, supports and is connected for energy transmission to a second wiring board, which may be similar to the first but which preferably comprises and supports control-contributing electronic components, other than mere wiring, for producing or augmenting the intelligence to be communicated or distributed to the next layer or plane. This may be considered the third or middle "level" or surface of the system. In turn, this third plane or surface, whether comprised of a printed wiring board with electronic components built in, or whether of some other composition and structure, supports and connects for energy transmission to a further and fourth board, layer or surface, which, for example, may be a printed wire circuit board No. 3. And, finally, this latter component or surface, supports and is connected for electric transmission to and from a fifth and front or outer surface or layer, which, in the case of an illuminated sign, for example, is made up of multiple element modules arranged contiguously over the entire display area.

To summarize, the structure of the present invention, comprises support apparatus and/or the use of a base or rear support, such as a supporting wall or structural sign base, with contiguous areas each bearing a module base or "tile" to constitute a base "level" or surface; the next level or layer is a printed wiring board No. 1, or equivalent; the next (third) is a "smart" layer or board which comprises not only electrical conductors but also intelligence directing components; the fourth "level" or layer is the final or third printed wiring board or equivalent, designed to transmit energy to (or receive it from) outer or front surface display (or collecting) elements of each module. The outer surface layer thus constitutes the fifth "level" or surface, not counting the supporting or rear wall or base.

In the case of a display device, such as a changeable sign designed to communicate changing information to the public, or to other groups of individuals, the first "level" or surface component, is made up of contiguously arranged module bases supported on a wall, signboard framework, or other suitable structure, so arranged that the individual tiles each occupy an area of predetermined dimensions. In the United States, where many structural frameworks, panel materials, etc., are based on 16-inch (40.64 cm.) centers or units of space, it is presently preferred that each module be designed to occupy a 16-inch square, i.e., a unit or an aliquot part of a standard panel width, studding spacing, etc. Printed or other wiring boards or panels are sized to overlie or correspond with multiple (or single) squares in each direction, vertical and horizontal, so that the 16-inch square becomes a convenient base for mounting and spacing all the components that make up the five layers or "levels" already discussed. By mounting eight rows of eight frontal elements (such as electrically lighted elements), each two inches (5.08 cm.) square, on or in front of each module base, a continuous display surface may be presented for view that may be as large in either vertical or horizontal direction, as may be desired. No gaps or open spaces are involved and this makes for highly versatile displays or collector arrangements. Thus 64 elements form each module, and modules may be variously arranged in as many columns or rows as needed, the arrangement of these 64 elements into smaller sub-groups being described further below.

Various additional uses, arrangements or applications of this invention, or of some of its aspects, will readily appear to those skilled in the art. Embodiments of diverse nature will suggest themselves as being suitable for a wide variety of needs and uses.

BRIEF DESCRIPTION OF DRAWINGS

FIG. 29 is an enlarged face view of the circuitry arrangements over a module area of a circuit board and FIG. 30 is a rear view of the same board or panel. FIGS. AA to GG, inclusive, are detailed views from various angles of fasteners and terminals by means of which conductors are secured to elements such as the wired circuit boards and the like.

DESCRIPTION OF PREFERRED EMBODIMENT

A detailed description of some of the elements shown in the various figures of drawings will be given before a general description and explanation of functions in detail is presented.

Figure 3:
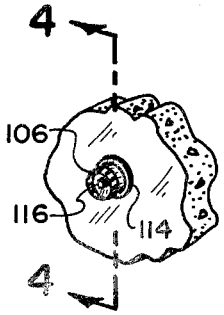
FIG. 3 is a small scale view of a rosette, such as in FIG. 2, attached directly to a supporting base or panel such as a wall of masonary.
Figure 1:
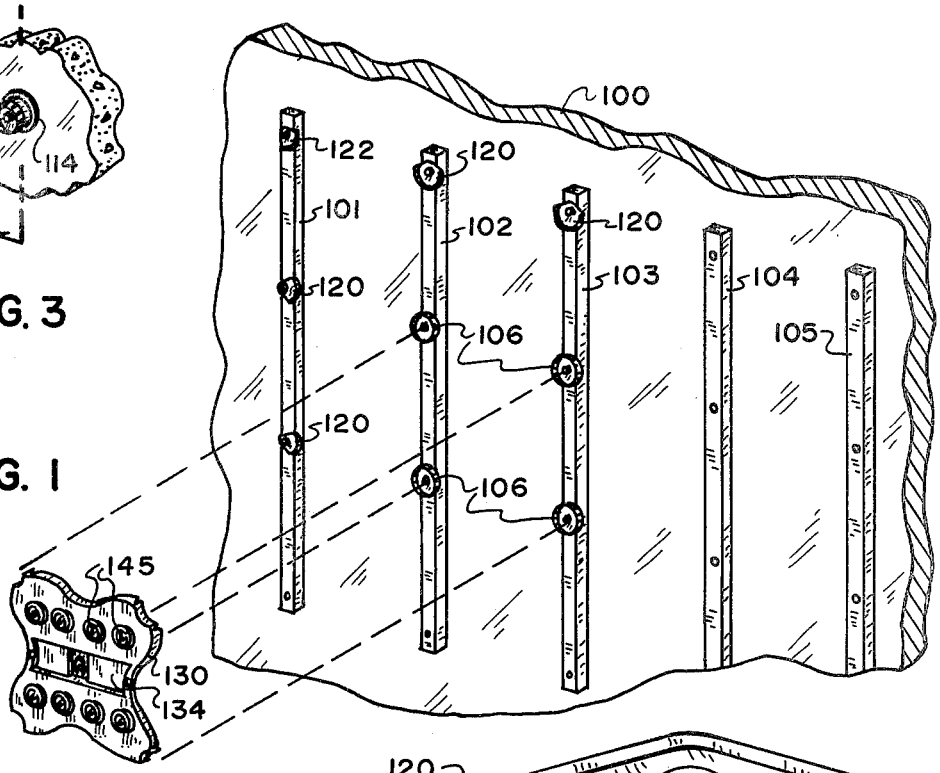
FIG. 1 is a fragmentary perspective view of a supporting surface, such as a wall, provided with means for holding individual backing units or "tiles", one of which is shown projected forward from FIG. 1.
Figure 4:
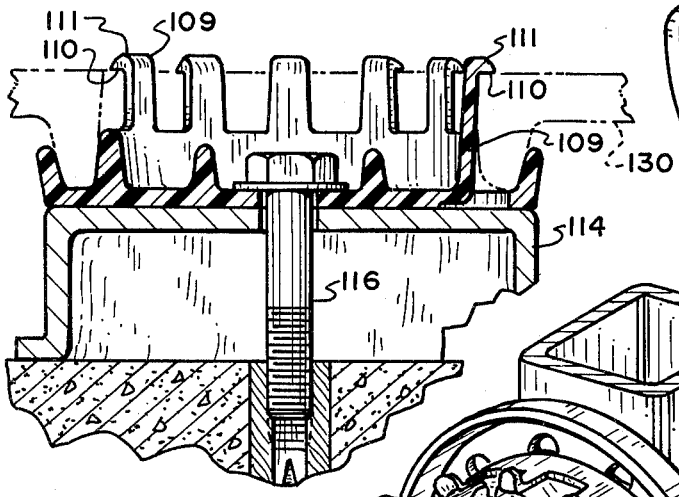
FIG. 4 is a detailed sectional view, considerably enlarged, of the rosette and supporting structure of FIG. 3.
Figure 5:
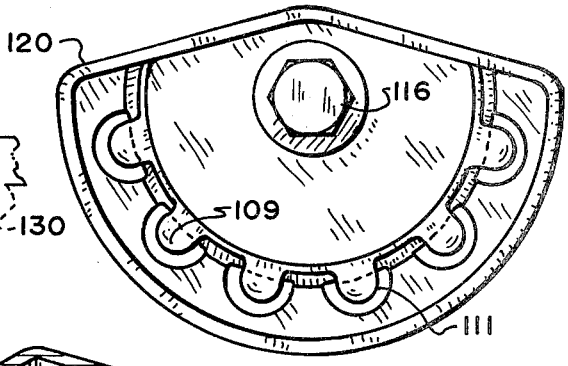
FIG. 5 is a front view of a modified rosette and FIG. 6 is a front view of still another modification of rosette.
Figure 2:
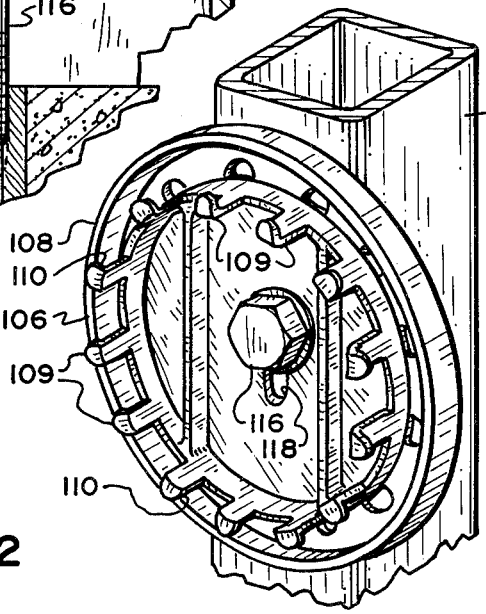
FIG. 2 is a detailed perspective view of a fastening device or rosette.
Figure 6:
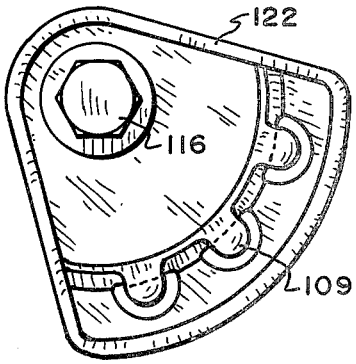

Referring first to FIG. 1, a typical background or base support for a sign or equivalent power control device, such as this invention involves, comprises a wall, or signboard of wood, metal or other material, indicated at 100. This wall is provided with a series of vertical support strips 101, 102, 103, 104, 105, etc., spaced preferably sixteen inches apart with reasonable accuracy so as to be compatible with structural elements of the present invention. In many walls, sign structures and other conventional building major components are usually based on 16-inch centers, or multiples, at least in the United States. However, other dimensions may be used if desired. To each one of these strips 101, 102, etc., are attached fastening elements such as 106. These also are uniformly spaced sixteen inches apart, for the particular embodiment herein described, up and down each of the strips. Strips 101, 102, etc., can be fastened either directly or indirectly to the wall or they may constitute per se a part of the basic structure. The fastening elements 106 are in the form of rosettes, one of which is shown in detail in FIG. 2; certain curtailed variations thereof are shown in FIGS. 5 and 6. As best shown in FIG. 2 each of the full rosettes 106 is a circular molded resilient but relatively rigid plastic device having a peripheral outer or back rim 108 and bearing a series of forwardly extending resilient detent elements 109, arranged in a circle or ring near the outer rim. Each element 109 has a radially outwardly projecting tip or holding end 110. That is, each of these fingers is a resilient, springy arm, strong enough to exercise a good holding function, explained below, and each tip is provided with a sloping or cammed surface 111, shown best in FIG. 4 so that when a "tile", 130, described later, having suitable fastening components also to be described, is pressed against a rosette, the fingers 109 will first spring radially inward, due to the action of the tile pressing on the sloping ends of the fingers until the "tile" is in place, whereupon the fingers spring outwardly for tips 110 to hold it securely. The tile 130 can of course be removed, if needed, by pressing the fingers radially inwardly with any suitable tool of obvious type. A full rosette 106 is used to hold the adjacent corners of four contiguous tiles.

When the "tiles", or module bases, are to be secured to a flat plane surface such as an ordinary masonry wall, as in FIG. 4, the rosette is first spaced outwardly from said wall by a suitable flanged base spacer or washer 114, shaped to accomodate a rearward projection of the tile which will be described later herein. As shown in FIG. 4 both the spacer or washer 114 and the rosette 106 may be secured to the wall by a bolt 116 threaded into a driven wall insert or plug 117 of known type, securely imbedded in the masonry. In FIG. 2, rosette 106 is shown provided with a slot 118 to accomodate bolt 116 so that the rosette can be adjusted by turning or sliding on bolt 116 to adjust its position and compensate for any inaccurate spacing between strips 101, 102, etc., or for misplacement of holes or plugs 117.

In FIG. 5 a modified or curtailed rosette 120 of roughly half circle shape is shown. This is useful for securing pairs of corners of adjoining tiles along one of the sides or ends of the display structure. Each element 120 is in other respects similar to the rosette 106, having the same sort of fingers 109 with their cammed surfaces 111 and outwardly projecting tips 110, as already described. In FIG. 6, another curtailed or modified quadrant shaped rosette 122 is shown which is designed particularly for holding a single corner element of a tile at the corner of a large display area. Cooperating tile parts will be referred to later, but the element 122, so far as its detailed retaining elements and its manner of fastening to the wall or basic structure are concerned, is similar to those of FIG. 2 and 5.

Figure 7:
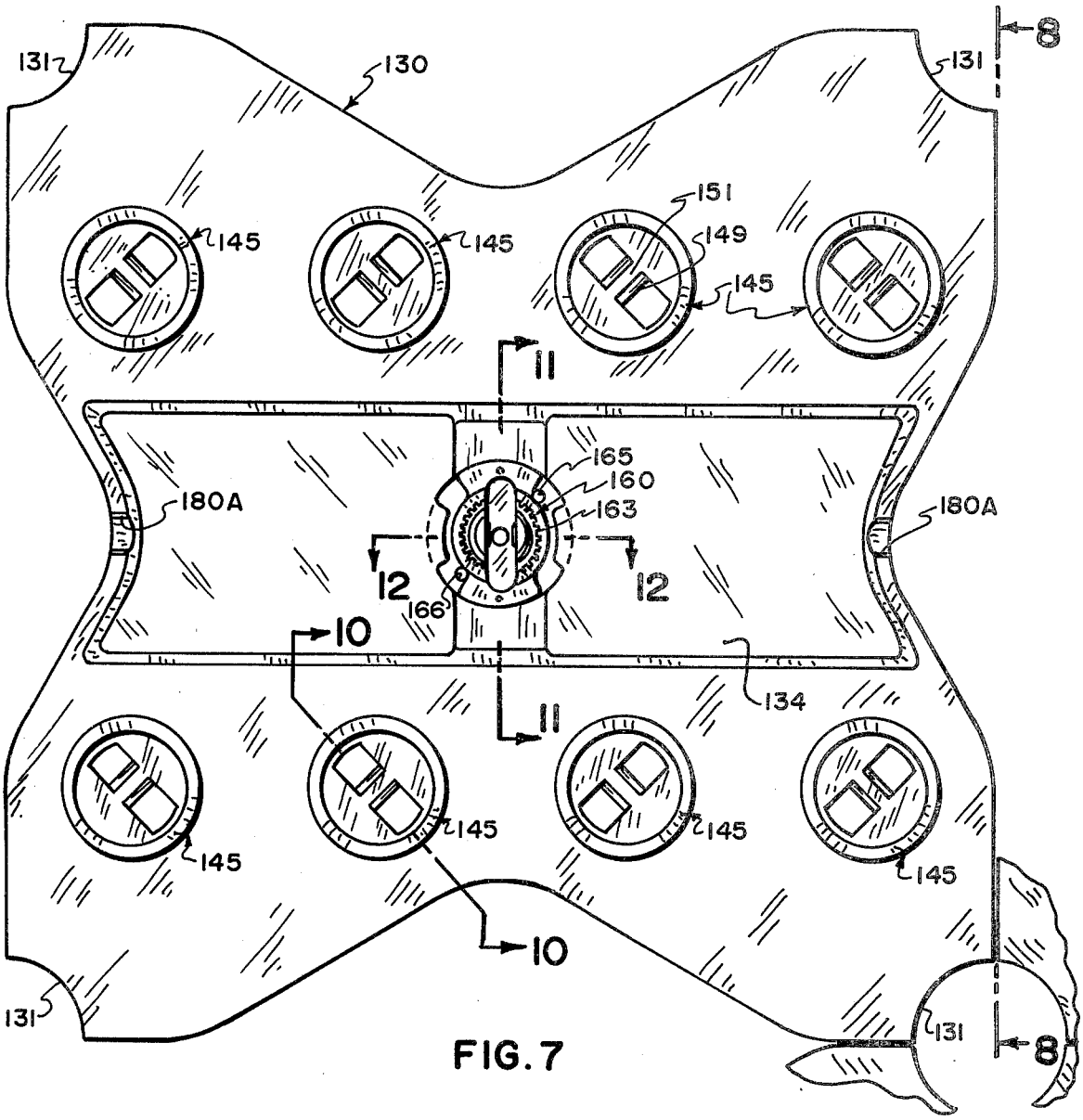
FIG. 7 is a large scale front view of one of the "tiles" or module base units, which are important support elements of the present invention.
Figure 8:
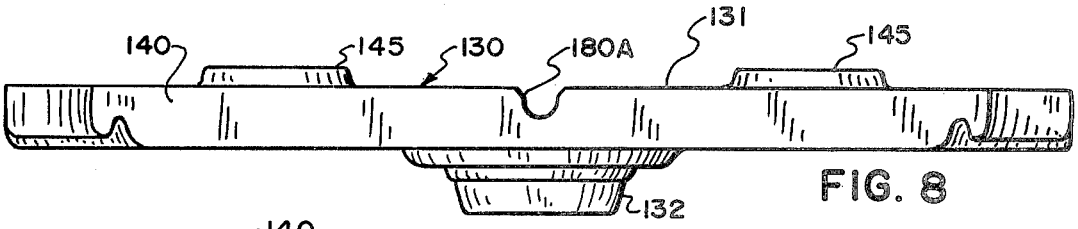
FIG. 8 is a side edge view of the "tile" of FIG. 7.
Figure 9:
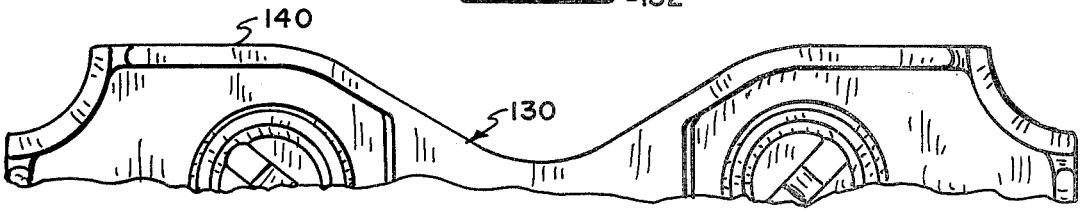
FIG. 9 is a fragmentary bottom or back face view of a portion of the tile of FIG. 7.

FIG. 7 shows a front view of a complete module support "tile" or base unit 130 which is an important and basic element of the present invention. Each "tile" backs up a module of the front face or display area. This tile or support base is an invertible symmetrical structure preferably made of molded or extruded plastic. This material is preferably a "foam" or related type plastic having a tough film on either face to give it a high strength-to-weight ratio. From a group of these structural bases a large sign base may be assembled which overall is of moderate mass and weight and still has the requisite strength for its purpose. As shown in FIG. 7, each of the module base units or tiles, 130 has a sort of indented boundary including quarter-circle cut-outs 131 at each of its four corners to accomodate a holding rosette which may be of the type shown in FIG. 2, where there are four adjoining tiles, of the type shown in FIG. 5 where there is no adjoining row of tiles, i.e., along a side or end of the sign, or of the type shown in FIG. 6 where there is a single corner of a tile not abutting against or adjoining any other tile unit. It will be understood then that most of the tiles, those in the main body of the sign, are held in place by groups of four quarter-circle cut-outs which meet at corners, using a complete circular rosette as in FIG. 2 for holding the four adjacent corners. Note the adjoining parts in the lower right hand part of FIG. 7. Each tile 130 is of an offset plane type construction basically consisting of a relatively thin web or body which is displaced upwards or downwards at various places or areas 132, 133, etc., as perhaps best shown in FIGS. 10 to 14. These provide the various structural support planes or areas needed for placement of other elements of the present invention. FIG. 8 shows an edge view of a tile, and FIGS. 9 through 13 show fragmentary sections, including important details for support or holding functions which will be described in due course. Each of the tiles is symmetrical, about both its horizontal and vertical axes; that is it may be turned upside down without any misplacement of its functions. However, it should not be turned 90 degrees from its normal position, in which a major elongated trough area 134 is horizontal, as shown in FIG. 7. Each of the tiles has this transverse depressed, central panel area 134. In the center of this area is a locking or constrictor means for holding certain electrical conductor means which will be described further, below.

Thus, each tile comprises basically a molded or extruded and fairly rigid sheet 130 of moderate thickness. This molded sheet is displaced upwardly or downwardly at various points or areas 135, 136, 137, FIGS. 10 and 11, as already mentioned, to provide depressions or raised portions to be used as basis or seats for other elements, etc. Other levels or planes are provided at 138 and 139 as shown in more detail in FIGS. 11 and 12. The tiles are formed, preferably by injection molding, or equivalent, from any one of several well known types of plastic materials, preferably the aerated or foam plastics, having cellular core structures enclosed between non-cellular skin or sheet elements to keep them light in weight, along with adequate strength. These tile materials, as a rule, are totally non-conductive of electricity, although in some applications it may be desirable to give them conductive surfaces, e.g., to coat or laminate a surface of the tile with a conductive layer of metal or other suitable conductive material if electromagnetic shielding is a useful capability of the tile. Preferably, in a preferred arrangement, each tile or module base is sized to fit within a dimensional envelope 16 inches square and is overall of uniform thickness, such as about $\frac{7}{8}$ inch thick, except for its center portion which is depressed more then other areas and protrudes further to the rear therefrom, as best shown in FIGS. 11 and 12.

Each of the tiles includes the four cut-out corners 131 already mentioned, along with various reinforcing flanges, particularly around the periphery. These tiles are each configured and designed to be pressed to position against the main support 100 and locked in this position by the fingers 109,110 of the rosettes 106, 120, etc., already described. Each tile has a peripheral reinforcing ridge or flange 140 around its margin for stiffening, and each includes a plurality, preferably eight, points of attachment 145 to which supports for printed wiring boards, wiring and other electrical elements described hereinafter may be secured. These points 145 are distributed symmetrically outside the tile certer. Each tile comprises also the centrally located recess 150, with counterpart 151, FIGS. 11 and 12, protruding at the back. Recess 150 is configured to receive and interlock with a rotatable locking or constrictor device 160, FIG. 13.

Figure 10:
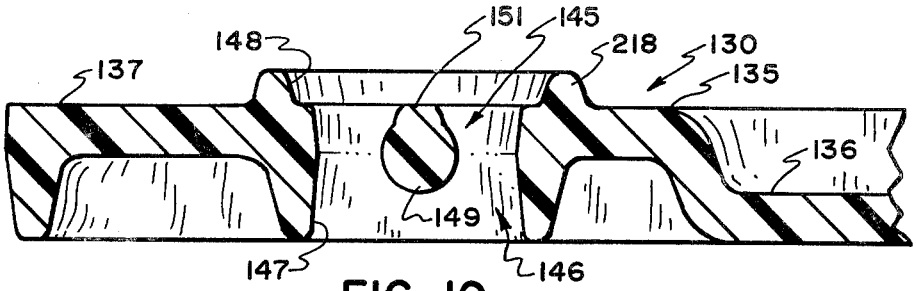
FIG. 10 is an enlarged fragmentary diagonal sectional view of a portion of the tile of FIG. 7, taken on line 10—10 of said figure.

Referring to FIG. 10, one of the attachment points 145 mentioned above, is shown as comprising a more or less rectangular opening 146 through the tile, bridged by a cross-bar or rod 149 which will be described further, below. Surrounding the lower part of opening 146 is a downturned flange 147; a circular recess 148 and flange 218 surround the upper part of the opening. Note that each tile (especially at its circular flanges 147 and 218) is configured so that a plurality of tiles will nest together for convenience in storing and shipping. The bridging bar 149 is of rod shape, mostly circular in section, and projects across the opening 146. However the circular section is modified by a rounded protruberance 151 at its top or front face which serves to stabilize and rigidify an upwardly or perpendicular outwardly projecting bifurcate hinged connector or "BHC" holding device 152, shown in FIG. 14. The latter device also is made of tough resilient plastic material. It is more or less of cotter pin shape, the legs 153 of which can be opened or parted by flexing its loop section 154 for putting it around the rod element 149. Its legs then can be closed and secured together for holding other elements. A somewhat similar arrangement is described in more detail in the parent application Ser. No. 628,786. The function and use of the rod element, 149, 151 will be further explained hereinafter.

Figure 11:
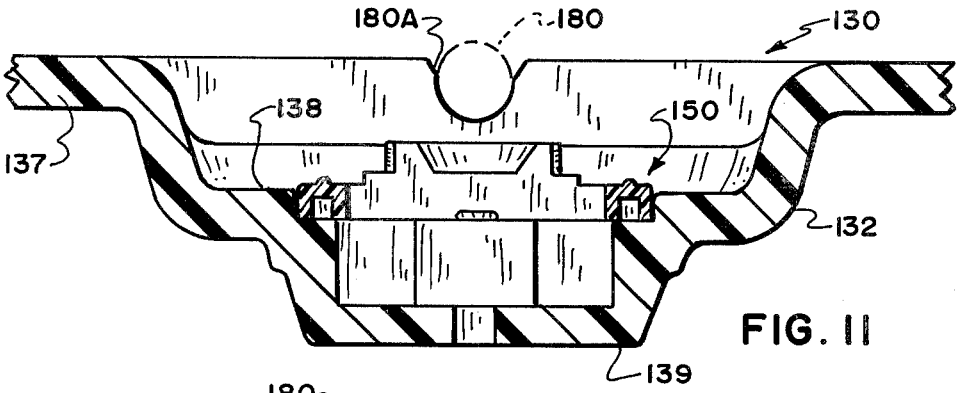
FIG. 11 likewise is a horizontal fragmentary sectional view taken substantially on line 11—11 of FIG. 7.
Figure 12:
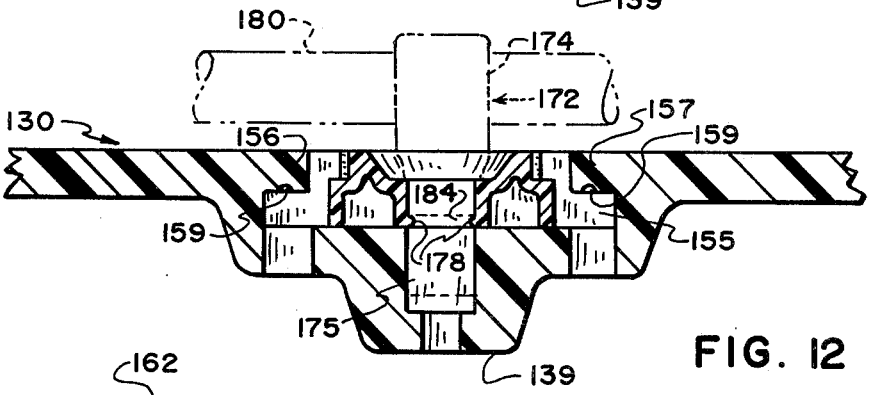
FIG. 12 is a vertical sectional view perpendicular to FIG. 11, taken substantially on line 12—12 of FIG. 7.
Figure 13:
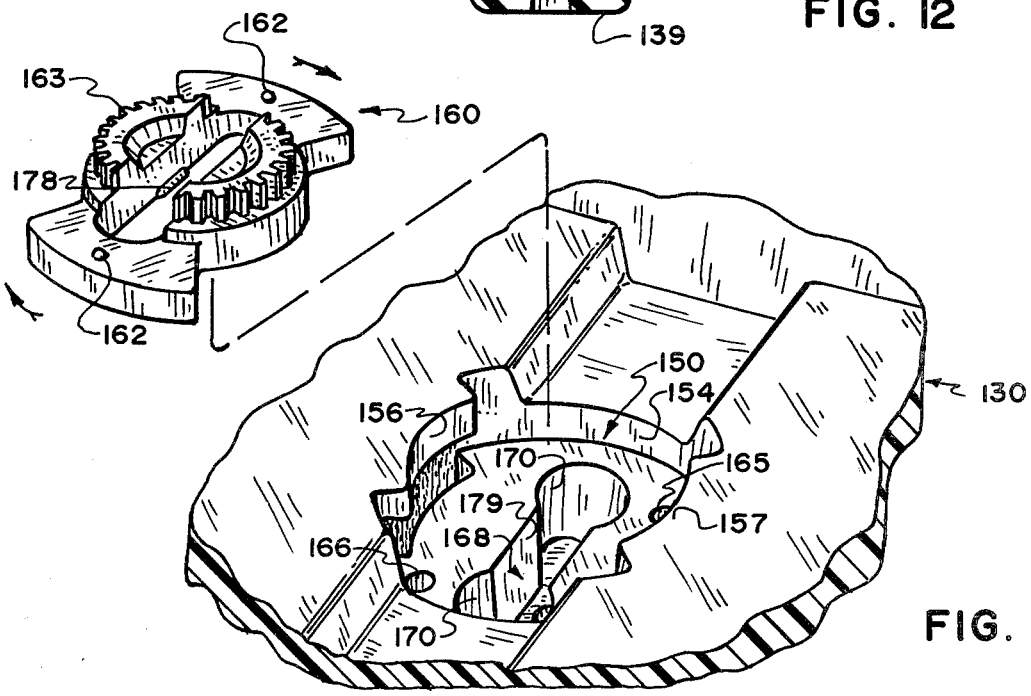
FIG. 13 is an enlarged perspective view of a central part of a tile as in FIG. 7, being partially an exploded view showing a displaced locking or constrictor device, and its seat in the tile.

FIG. 11 shows a sectional view of the central part of a tile 130 with its locking mechanism or "constrictor" 160, shown in greater detail in perspective, in FIG. 13. FIG. 12 is a vertical sectional view, at right angles to FIG. 11. The tile 130 has the central more or less rectangular depression 150 in which is molded a lower (or more rearward) circular opening 155 having certain over-hanging elements, 156, 157 above or in front of it. This is adapted to receive the rotatable locking element or "constrictor" 160, FIG. 13. The circular opening 155 is only partly over-shadowed by the flanges 156 and 157, shown in section in FIG. 12. These serve to retain the rotatable "constrictor" member 160 in place when it is turned with its segment shaped end elements 158 underlying the flanges. The bottom or back side of each flange bears a small recess 159 into which small protuberances or bumps 162 on the top or front face of the member 160 will snap resiliently into place and engage the recesses 159 when the constrictor is rotated to a holding or locking position. These engagements tend to lock the device 160 against inadvertent rotation, due to vibration or other forces. Thus, when the device 160 is locked, in place, its segment shaped ears 158 underlie the flanges 156, 157 and retain the constructor firmly in place. Constrictor 160 is provided also with a circular gear shaped element 163 integrally formed, which is adapted to be rotated by a small key or gear device, of general type well known, for use with chucks, etc., the pivot end of which can be inserted into an opening 165 and/or 166, FIG. 13, in a lower or base part 167 of the recess 150.

Figures 15, 15A, 16:
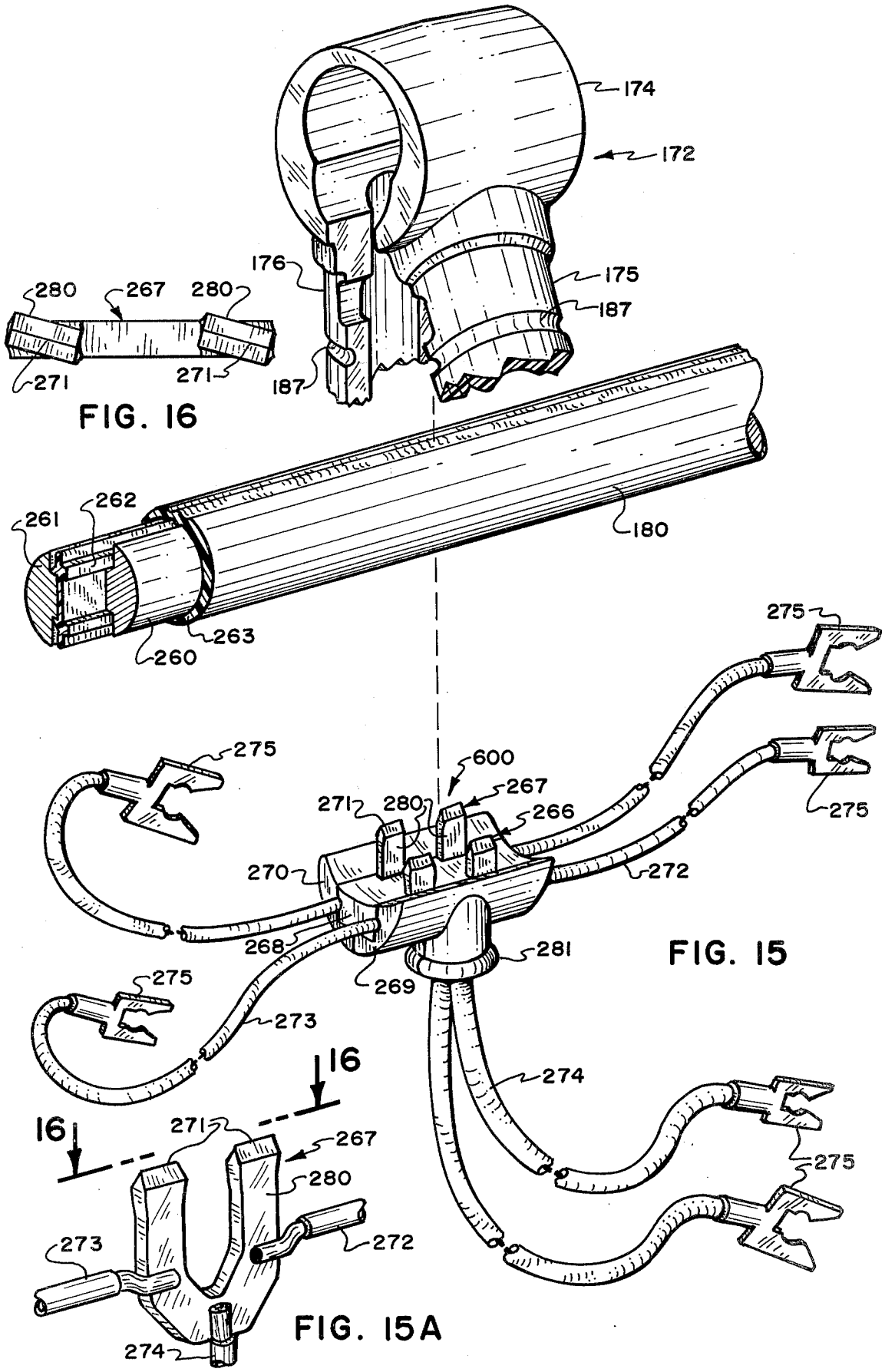
FIG. 15 is an exploded perspective view of an electrical connection assembly which includes the penetrating parts shown in FIGS. 15A, 16, 17 and 18 in addition to part of a buss and BHC holding element associated therewith.
FIGS. 15A and 16 are detailed side and end views of a penetrating pronged contact element.
Figure 19:
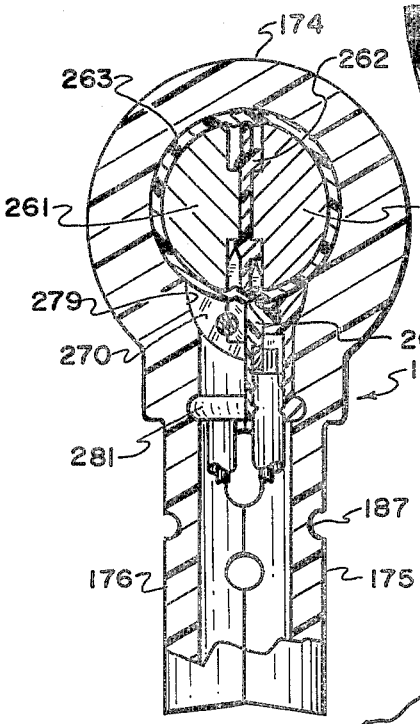
FIG. 19 is a smaller scale view of the parts shown in FIG. 17, with support means and certain other details added.
Figure 17:
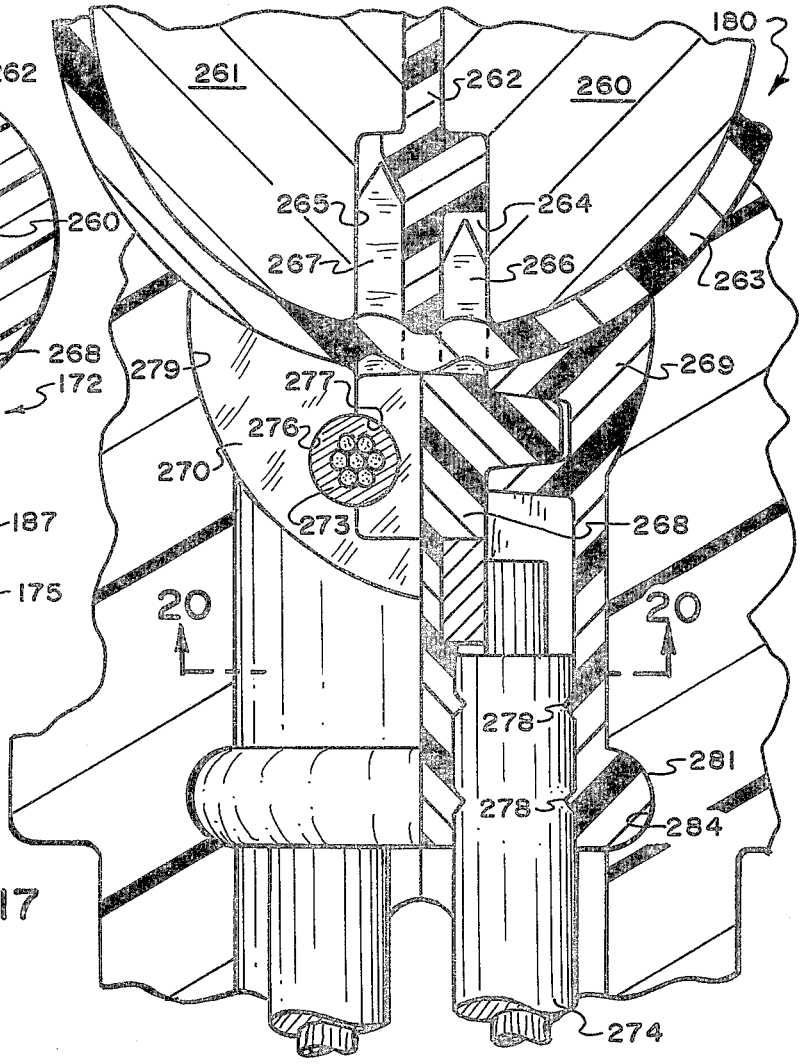
FIG. 17 is a side view, partly in section and considerably enlarged, of a buss and associated elements, including penetrating pronged contact means and support therefor, for taking electrical current to or from said buss.

An opening 168 of double key-hole shape, that is, with parallel sides 169 in its middle part and larger rounded end portions 170, is formed in the deepest part of recess 150, to first receive end portions of the separated legs of a bifurcate hinged connector, or "BHC" fastening device 172, FIGS. 15 and 19, of the same general type as device 152 mentioned above. This "BHC" also has a resilient, flexible loop section 174 which can be sprung sufficiently to permit its legs 175 and 176, best seen in FIGS. 15 and 19, to be spread apart far enough to receive a rod, such as a conductive buss element 180, to be described in greater detail hereinafter. While the legs are somewhat spread apart as just mentioned, they still may be projected down into the round end openings 170 of the double key hole 168; thereafter the legs may be brought together or almost together. Then the device 160 is rotated by a key inserted in a hole 165 and/or 166, the key having teeth to engage gear 163. This rotation serves to bring and hold the legs 175, 176 snugly together. Each of the wall portions 179 on the opposite sides of slot 168 bears a small rib 178, FIG. 12, which is adapted to engage in a peripheral groove 187 in the "BHC" device 172 when its legs are closed together and turned, as just described. This locking arrangement is seen in FIG. 12, where the small protuberances 178 are actually engaged with the peripheral slot 187. These parts have sufficient strength to hold the "BHC" 172 and its captive conductor rod 180 so that the latter is retained in a fixed and accurately spaced position above or in front of the face of tile 130.

Figure 14:
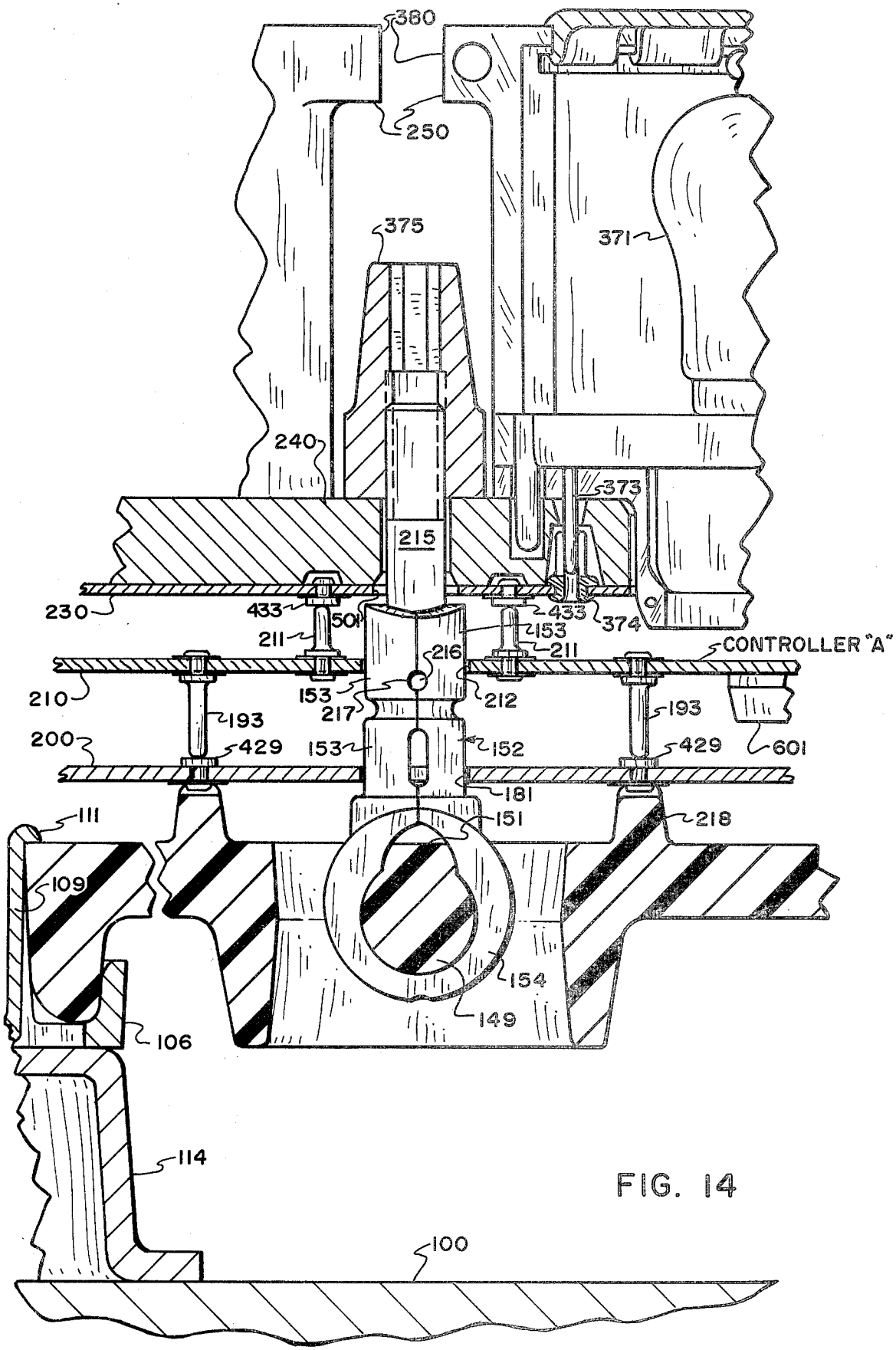
FIG. 14 is a large scale detailed view through a section of a sign or structure embodying several layers of components which characterize the present invention.

FIG. 14 shows on larger scale, which may approximate actual size, a small section of an assembly wherein parts of each of the five "levels" i.e., layers or plane elements described above, are shown in some detail. The back wall element, indicated at 100 at the bottom of FIG. 14, is provided with a spacing device 114 of the type already mentioned, FIG. 4. Seated on or against this spacer is shown a portion of a "rosette" 106, with a finger 109 and a tip 111 overlying and holding in place an upper or front edge of a tile 130. A BHC 152 is shown surrounding a rod element 149 as in FIG. 10, and is cut-out at the upper part of the opening to receive the projecting part 151 of said rod so that when the legs 153 of this BHC are closed together, as shown, the BHC cannot be rotated around the rod 149 and must stand erect or perpendicular to the wall plane. Note that the alternating angular (preferably 45°, as shown in FIG. 7) orientation of the rods 149 also helps to rigidize the assembly; such orientation also facilitating the flow of plastic during the injection molding of the tile. The resilient legs 153 of each device 152 are held closed together, as shown in FIG. 14, by a hole 181 in the first printed wiring board 200 (PWB#1) which now is set in place. When it is thus in place, of course the legs 153 cannot separate.

Spacer devices 193 of a type shown generally in the copending application Ser. No. 628,786 are shown, there being three of these equally spaced around each of the eight BHC devices 152 normally mounted on a tile. On the top of these spacer devices is placed a second printed wiring board 210 (PWB#2) which, as previously indicated, includes not only wiring or circuitry elements on its face but may include semi-conductors, combinations of solid state devices, and other electronic parts for controlling logic of circuits which emanate from or to this board and to or from the third or front board 230. (PWB#3). The latter is supported from board 210 by further groups of spacing elements 211, each group being nine in number. These, as also explained in application Ser. No. 628,786, are arranged in a circle also equally spaced around the upper part of the forwardly projecting legs 153 of BHC device 152. Here again, an opening 212 is provided in panel 210 (PWB#2) to receive the upper or forward ends of legs 153 when they are closed together.

A vertically or forwardly projecting threaded rod element 215 is held between the legs 153, bearing a cross pin 216 which is gripped between semi-circular notches 217 in the edges of these legs when they are closed together. Rod 215 supports forward elements 240, as explained more fully below and in the present application Ser. No. 628,786. With this arrangement, the rod 215 cannot be pulled upwardly out of the device 152, until its legs are separated and the legs cannot be separated unless the plates or boards 200 and 210 are taken off the BHC device. A cap nut 375 screws onto rod 215.

The upstanding flange or rim 218 surrounding opening 145 in the tile 130 serves to support the first printed wiring board 200 with suitable fastening attachments 219 being provided. In general, the spacer devices 193 and 211, which also serve to hold boards 210 and 230, are quite similar to or may be identical with those described in the co-pending application Ser. No. 628,786. On the upper or front wiring board 230 are mounted the additional base elements 240 on which the illuminated or visually effective sign elements 250 are mounted, in turn, as described more particularly in the co-pending application. These per se are not a part of the present invention.

The dimensions of the units preferably are such that 64 of these elements 250 can be mounted on or in front of each tile 130. That is, if the tile or module area, or a module, occupies or spans a general area 16 inches (0.4064 meters) square, the individual elements, which are each 2 inches (5.08 cm.) square, are arranged in eight rows of eight, i.e. eight columns also. These elements completely cover the front of each of the tiles except for minor cut away corners and by activating, turning or energizing selected ones of the elements any alphabetical character, numerical character or other display symbol will be exposed or activated to give desired information. Each element may be energized selectively, lightened up or darkened, or turned, as required, to give the desired display effect. The tile flanges or rims 218, shown also in FIG. 10, which surround each of the eight openings 146, across each of which a support rod 149, 151 passes, thus serve as multiple bases of support for printed wiring board 200 (PWB#1). Printed board 210 which is the "smart" one, containing at least some of its own logic circuitry in appropriate cases, is supported on the first board 200 by the spacers 193, three being arranged around each of the eight devices 145, 149 on a given tile. Hence, there are 24 spacers 193 and 72 spacers 211 between boards 200 and 230 supported above or on each tile 130. Through these spacers, as further explained below, electrical currents may be passed from one level or plane to another, being tied in with the circuitry on the respective boards. The main electrical power for (or from) these purposes comes from or to the multiple buss 180, one of which is shown in outline in FIGS. 11 and 12. This buss, its supports and electrical connections, will next be discussed with reference particularly to FIGS. 15 to 19.

Each of the busses 180 is a composite structure which consists, in cross-section, preferably of two essentially semi-circular bars 260, 261 of copper or other good conductive metal, spaced apart by an insulator member 262 and surrounded by an imperforate but puncturable insulator sheath 263. Thus the bars and insulator 262 form a sort of sandwich. The bars are each cut out at 264 and 265 alongside of insulation layer 262 to provide a small recess into which contacting elements 266 and 267 may be inserted in a manner to be described below. Thus, each of the buss bars 180 passes along just above, or in front of the depressed trough 134 which runs transversely across the tile, as shown in FIG. 7. With this arrangement the buss bars 180 (which do not appear in FIG. 14) lie between the tile elements 130 and the first printed wiring board 200. By connecting wires from panel 200 (PWB#1) to these bars, electrical current may be distributed to (or from) the first board. From board 200 the current may be taken to board 210, through the 24 spacer contact means 193, and from board 210 to board 230 through the 72 spacer contact elements 211. Thus signals to (or from) the appropriate frontal surface elements 250, mounted on their bases 240, FIG. 14, are connected to or from board 230, onto or from board 210, and to or from board 200, and finally to or from buss bars 180. Further details of these supports, spacers and electrical connections will be given below.

Referring now to FIG. 15, a buss 180 is shown below a BHC type support 172 which has already been mentioned in connection with FIGS. 12 and 13. Its loop part 174 surrounds the buss 180 and tightly grips it when the BHC legs as described above are held tightly together. The loop part 174 is flexible enough that the legs can be separated, as shown in FIG. 15, for the loop to be placed around the buss and then closed as shown in FIG. 19. The legs are held together tightly when the BHC is put into the double key hole slot 168 of FIG. 13 and the constrictor device 160 is turned about 90° to firmly hold the legs 175, 176, between the parallel side walls 179 of this slot, as explained above.

A wiring unit 199, FIG. 15, supports insulation penetrators and various wires for making connections to the first panel. The penetrating elements 266 and 267, per se, are each formed as double pronged sharp ended conductor means, the sharp edged blades 280 each being deformed with a slight twist, FIG. 16, so that they will exert lateral pressure against the respective faces of the cut-out parts 264 and 265 of the buss bars 180. That is, they are formed of spring metal with sharp ends 271 so that they may be inserted through the insulation layer 263 around the buss bar elements, which they are sharp and stiff enough to penetrate. They tend to exert pressure right and left, FIG. 16, against the respective insulator faces and the opposed metal faces of the bar elements, thus insuring good conductive contact with the buss bars. In certain applications of the present invention, it will be a desirable objective to, in effect, double or at least increase the area of electrical contact between the U-shaped penetrators and their respective buss halves and thereby increase the electrical current capacity of the contact. This objective can be achieved by any of a variety of modifications of the illustrated embodiments. For example, the insulator 262 in FIG. 16 can be provided with conductive sides which do not contact each other. Another example would be to make the void 264 in the form of a two-sided trench in each buss half. Other modifications will be apparent to those killed in the art, all of which modifications are encompassed by the appended claims.

Figure 21:
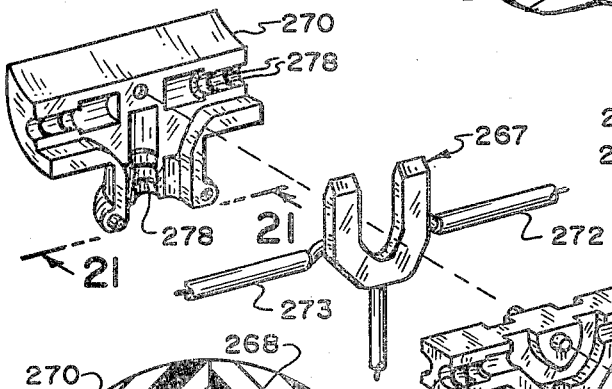
FIG. 21 is a fragmentary enlarged view taken substantially along line 21—21 of FIG. 18.
Figure 21:
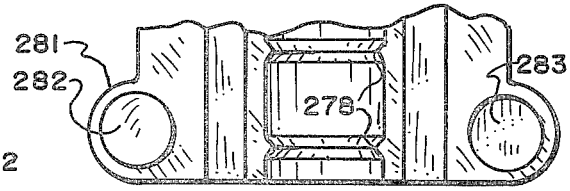
Figure 20:
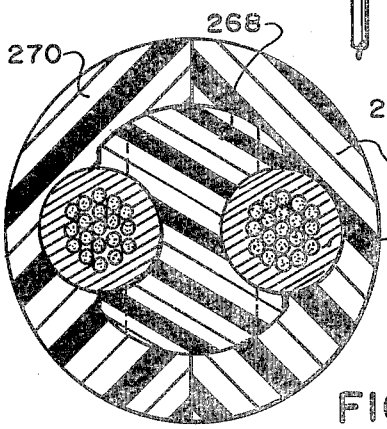
FIG. 20 is a transverse cross-sectional view taken substantially along line 20—20 of FIG. 17.
Figure 18:
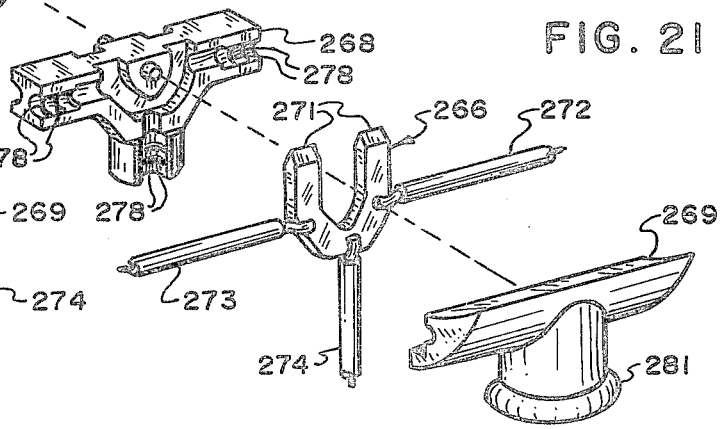
FIG. 18 is an exploded view of penetrating connector elements and associated parts for taking power from an insulated buss.

The elements 266 and 267 each have two or three or more connecting wires which are arranged with conventional connector tips 275; three are shown in FIG. 15. Wire 272 projects to the right, wire 273 to the left, and wire 274 downwardly, or forwardly, as seen in FIGS. 15 and 15A. These pronged penetrator elements are assembled between insulator devices, including a molded or preformed back member 270, an intermediate member 268 and a front member 269, FIG. 18. These parts are appropriately grooved and nothced to receive snugly the penetrators themselves, along with the wires attached thereto. The assembled parts are shown in FIG. 15, being designed and dimensioned to fit snugly within a cut out semi-circular space 279 beneath the main loop 174 of a BHC connector 172 and between its closed legs 175 as seen best in FIGS. 18 and 19. A wire 273, greatly enlarged, is shown in section in FIG. 17, projecting directly towards the viewer and lying in slots or grooves 276, 277 formed respectively in the insulator elements 270 and 268, FIG. 18. Similar grooves are formed in the facing parts of elements 268 and 269. The wire 272 to the right is similarly supported and enclosed, therefore, as are the forward pair of wires 273 shown in FIG. 20. (These wires would be projecting forward in the usual sign or display arrangement.) Thus, all the wires are accomodated by mating grooves formed respectively in the back and rear face of the middle insulator 268 in the front of the back insulator 270 and in the back of front member 269, as seen in FIG. 18. These grooves are provided with small annular internal ribs 278, FIGS. 19, 21, seen in the rearmost element 270 of the assembly of FIG. 18, to grip or bite into the insulation layer around the wire and hold it firmly when the assembly is secured together. This whole assembly is contained within the loop part 174 and between the legs 175, 176 of the BHC 172 which, when assembled, has its legs secured in the slot 170 in the center of the tile 130. The front and back insulator members (as they are seen in FIGS. 18 or 19) are symmetrical and interchangeable and are each provided with a lower (or front) annular rim or flange 281. A small cavity 283 is formed in one edge and a small stud detent 282 in the other edge of each of these parts, so that when they are assembled, they are held in alignment between the legs of BHC 172 which encompass them, as best shown in FIG. 19, wherein certain parts are cut away for clearer description. The rim 281 is held by matching grooves 284 formed within the legs of the BHC 172, so that the whole assembly is firmly locked in the BHC. Prior to being so locked in the BHC, the parts of FIG. 18 preferably are inseparably connected by means of solvent bonding or ultrasonic welding.

The wiring unit, as seen in FIG. 15, is provided for installation in the center of each tile, or each module occupying a similar area. All the parts are held in place firmly after assembly, by the BHC 172 and with the various grooves and other detent elements just described. This assembly affords a simple, efficient and electrically sound connection between the buss and the associated elements or parts which are to be connected thereto. A buss 180 passes across the middle and along the entire horizontal row of tiles or modules to supply power or take current from them. The means by which the buss is supplied with power will be described later herein. Mechanical and electrical connections from panel to panel, or from one wiring board or panel to the next, also will be described in further detail.

In some cases it may become desirable to use individually mounted support elements, such as BHC devices or equivalent means, which can be mounted singly on a base support, such as a wall. In such cases, the tile 130 may be replaced, in effect, by a group of such means and devices to accomplish the same result. Support devices such as BHC's 152 and 172, see FIGS. 10 and 14 for devices 152, and FIGS. 12 and 16, 19 for device 172, may be individually mounted in their respective eight distributed points in a module, for the former, and in the center for the latter. The devices shown here are particularly designed to replace the mounting elements 149 in areas 145 of tile 130, FIG. 7.

As indicated above, the tiles 130 are symmetric, and can be inverted without changing their relationship to other parts. The areas or cut-outs 145 which serve to mount the BHC devices 152 are also arranged symmetrically about the center of each tile or module area. The whole circuitry which supports the modules and their individual elements also can be reversed, inadvertently or otherwise, without interfering with proper electrical connections. In other words, the whole module area circuitry, aside from the tile per se, is adapted to be supplied with power to which various components can be attached in either position without alterations. No miswiring occurs, even if a whole wiring unit is inverted, whether supported on a board or base tile at the moment or not. This will be further explained below.

Figure 22:
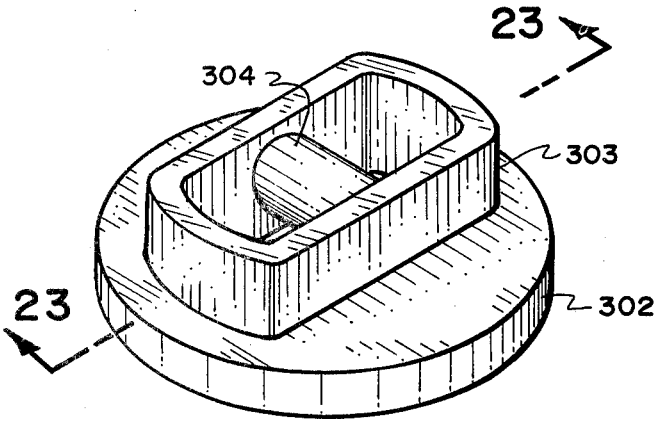
FIG. 22 is a perspective view of a modified support base for a BHC device and FIG. 23 is a section on line 23—23 of FIG. 22.
Figure 23:
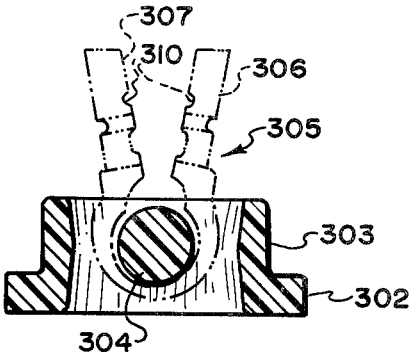

Returning to the description of basic support elements, FIGS. 22 and 23 show a support unit 301 which comprises a flat circular base 302 adapted to be supported on any flat surface and having an upward or forwardly projecting flange or collar 303 of generally rectangular outline, with rounded ends. A cross rod, or shaft 304, preferably molded integrally with the unit, bridges across the collar inside the opening, to receive and support a BHC device 305. The latter is shown in FIG. 23 with its loop around the rod 304 and its legs 306 and 307 parted and flaring outwardly from each other. This assembly can replace an opening 145, of FIG. 7, in a unit 130, to support panels and other parts as in FIG. 14. Eight devices such as these supported on any suitable device will replace the eight mounting positions of FIG. 7. That is, each of them fulfill the function of a hole, crossbar and regional area around each opening 145, shown in FIG. 14.

Figure 24:
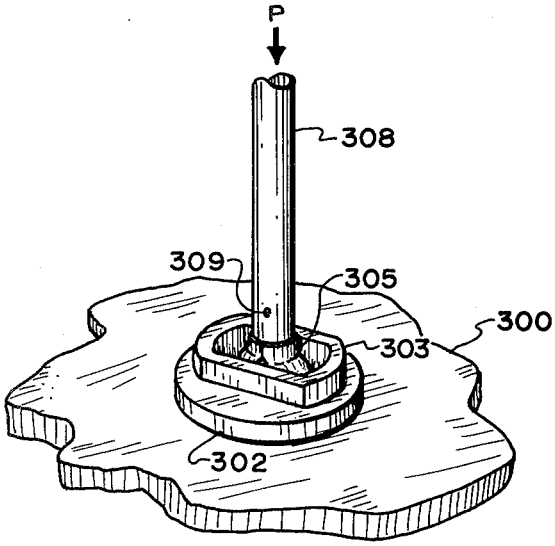
FIG. 24 is a perspective view of a further modification base and BHC mount, FIG. 25 being a sectional view of the same with parts in altered position.
Figure 25:
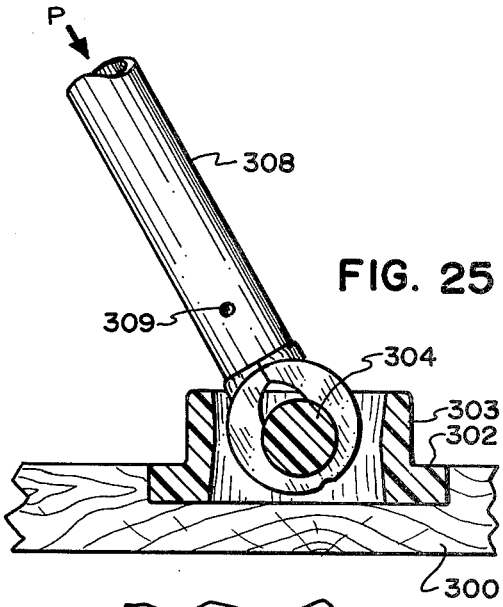

FIGS. 24 and 25 show a device having an essentially similar circular base 302 with a projecting hollow rim or collar 303 and a BHC device 305 projecting upwardly therefrom. The legs of the BHC in this case are held together closely by a hollow tube or post 308, which surrounds them and the tube is prevented from being pulled off the legs by a pin 309 inserted through holes in the tube walls and passing through the mating notches 310 in the matching edges of the BHC legs. See FIG. 23. As shown in FIG. 25, the loop portion of BHC 305 surrounds the bar or rod 304 neatly but, unlike the cross bar in FIGS. 10 and 14, in this case it has no lobe 151 to prevent its turning around the rod 304. Post 308 can be pivoted to right or left, the latter inclination being shown in FIG. 25. This may be convenient for supporting various elements in some cases.

Figure 26:
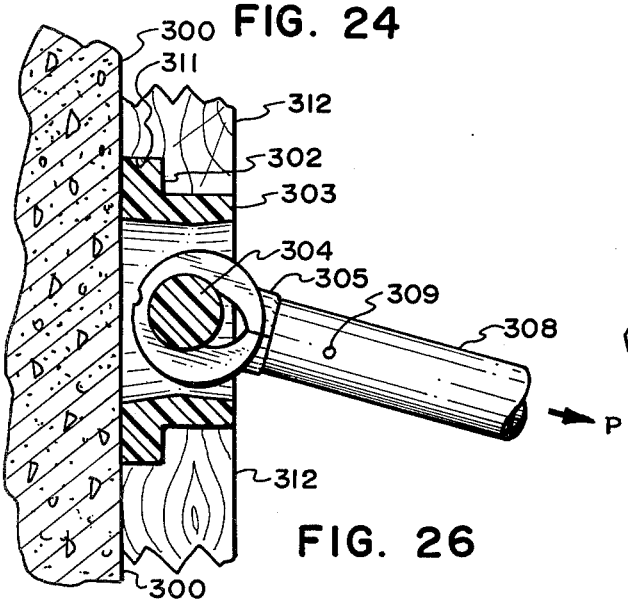
FIG. 26 is a side edge view of another base and BHC device partly in section.
Figure 27:
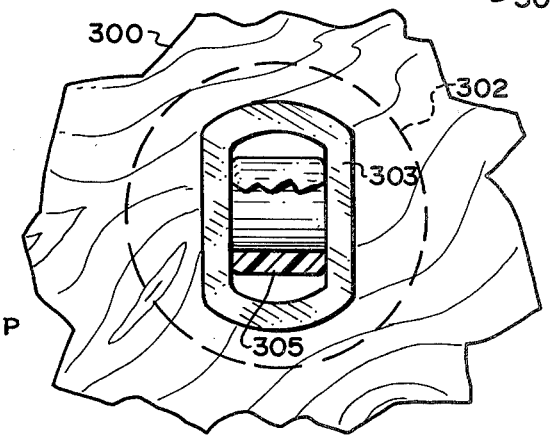
FIG. 27 is a face view, partly in section, of the device of FIG. 26.

FIG. 26 shows an essentially similar base mounted within an opening 311, formed in the back of a panel or of lumber, plywood or the like, 312. The latter is mounted on a base support such as wall 300. Here again, the BHC is not confined to a perpendicular position but can be rotated about the bar or rod 304 to various angles, giving it some versatility at the expense of rigid projection at right angles to the base support.

Figure 28A:
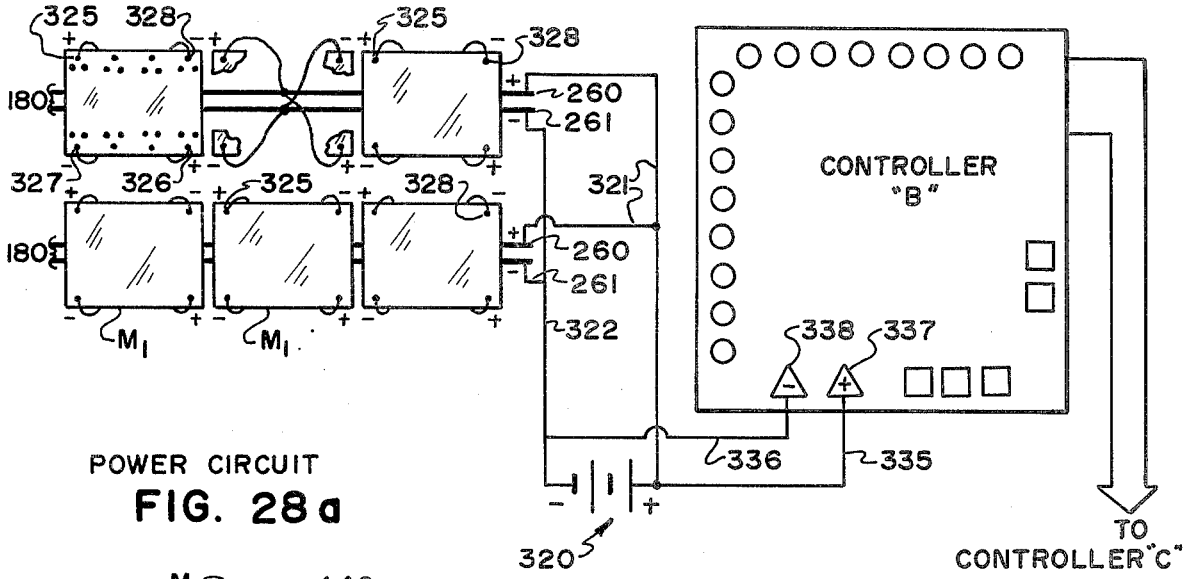
FIG. 28A, 28B and 28C are diagrammatic plan views showing successively the wiring sequence and circuitry arrangements for a group of modules.
Figure 28B:
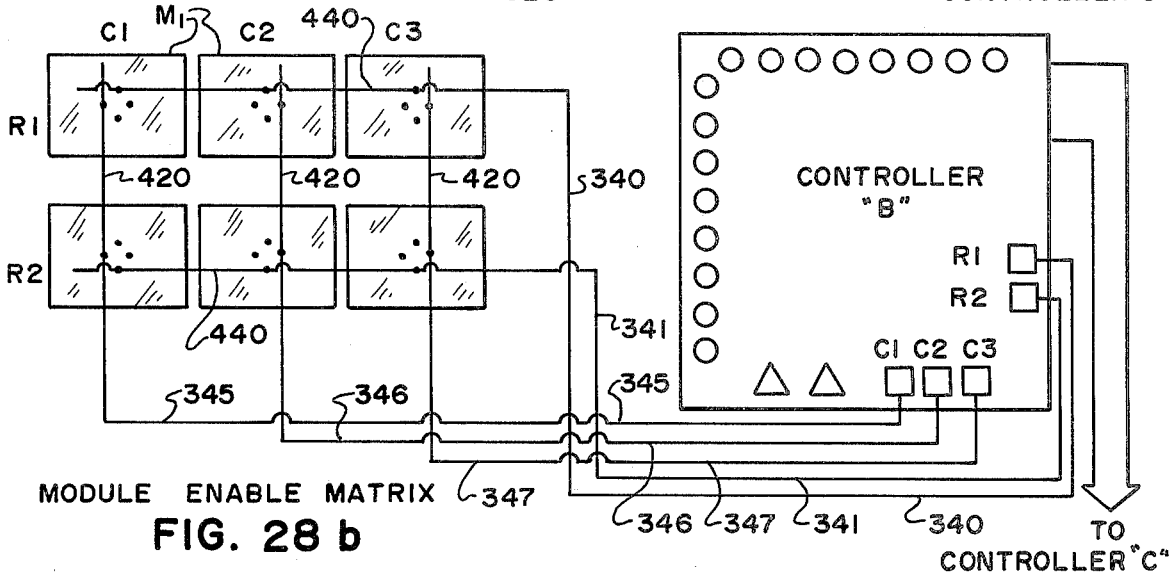
Figure 28C:
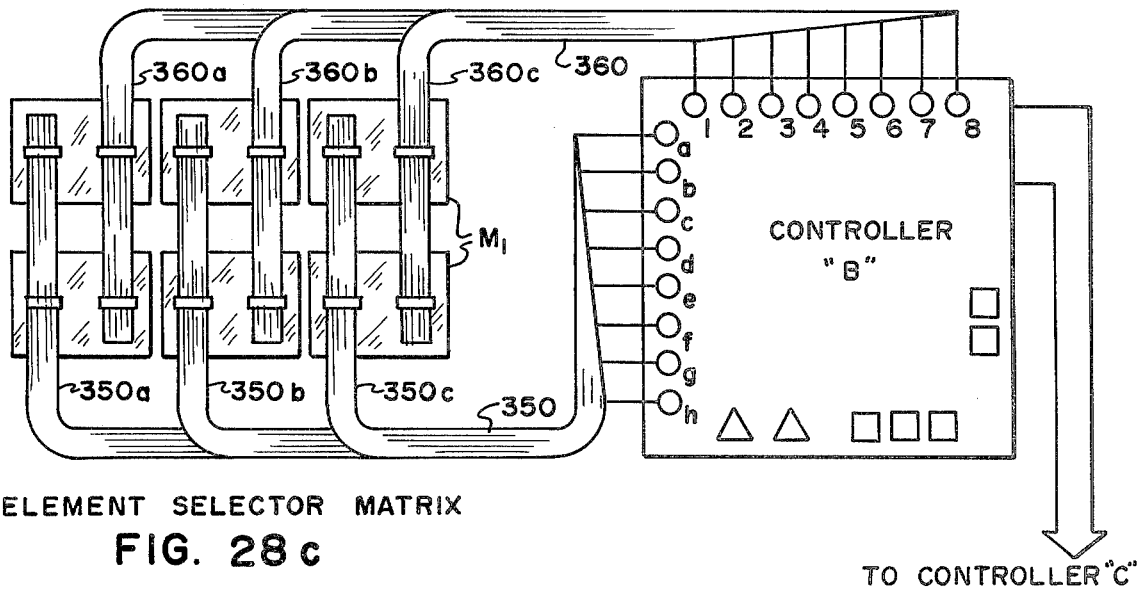

FIGS. 28*a*, 28*b* and 28*c* represent respectively panel areas at different "levels" of power distribution and control. In all cases, these panel areas are connected electrically to a central power station or source (or power receiver in the case of an energy gathering system). This source is shown in the form of a conventional electrical battery 320 in FIG. 28*a*, but it may be any suitable power source (or receiver). Its positive terminal is connected through a line 321 to positive terminals 260 of a buss or plural busses 180, FIGS. 15 to 19, the latter being connected in turn to positive terminals 325 and 326 at the upper left and lower right of each of a group of modules M1. The latter are representative of a large display area, but only a limited number, six, are shown for simplicity of description and explanation. The negative conductor 322 from power source 320 is connected to the negative half 261 of each buss (the two halves are shown as parallel conductors in FIG. 28*a*). From buss elements 261, connections are made to each module or module area and to a negative terminal 327 at the lower left and a negative terminal 328 at the upper right of each module or module area. With this arrangement, the module base or panel so wired can be turned upside down without changing the polarity of any of the connections. This simplifies assembly, requiring no particular electrical skill on the part of those who build the sign or display.

The wire leads 272 (see also FIG. 15) which extend from the pronged connectors 266, etc., and which penetrate the outer insulation layer of the buss halves, as described above, are connected to the positive terminals 325 and 326 while the similar negative leads from the pronged devices 267 are connected to the terminals 327 and 328. Downwardly extending leads 274 of FIG. 15 are not used in the arrangement shown in FIG. 28*a* but may be connected to other elements in the display system. In this connection, FIG. 15 should be compared with FIG. 28*a* and particularly with the small "X" wiring arrangement shown in the middle module of the upper row at the upper left of FIG. 28*a*.

The power source terminals are connected also in parallel with lines 321 and 322 by leads 335 and 336, respectively, to the positive terminal 337 and the negative terminal 338, of the Controller "B" at the upper right. The construction and manner of operation of this controller form no part of the present invention, and it will not be described in detail. Suffice it to state that the total control function of the entire system is cooperatively shared by controllers A, B and C or other combinations thereof; said controllers preferably incorporating microprocessor computing means. The latter is usually conventional and well known in the art.

In its simplest form, Controller "B" is merely a terminal board electrically interposed between controllers "A" and "C", while in its more complex embodiments it incorporates microprocessor means. In either case, it preferably is provided with a "module enable matrix" and "element selector matrix" which function cooperatively in a general manner well known in the art to sequentially scan and control all of the system's information displaying elements.

In FIG. 28*b*, a group of six modules M1, arranged in two horizontal rows of three, or in three vertical columns of two, are shown. The number will ordinarily be much greater. Controller "B" which can be considered equivalent to a main or central station bears a contact for each column and a contact for each row in any case. In this case there are two row contacts, R1 and R2, connected by leads 340 and 341, respectively, to the two rows of the display modules and extending entirely across each row. Similarly, column contacts of which three are shown, C1, C2 and C3, are connected respectively by leads 345, 346 an 347, to wires which traverse the three columns C1, C2 and C3, respectively. Now, if it is desired to activate or "enable" the middle module in the upper row, the controller "B" will provide a signal to it's contacts, R1 and C2. This prepares or enables the module to pass further elemental signals to selected ones of its own elements. It will be understood of course, that multiple modules, in fact all of them, can be enabled simultaneously if desired, and multiple elements on one, some or all of the modules may similarly be activated simultaneously, or substantially so, by a rapid scanning action, well known and widely used in computer technology. The signals are preferably consecutive and not truly simultaneous. However, they are produced and received so rapidly that they will ordinarily appear to the observer as simultaneous. Each module, thus enabled, is ready to receive and transmit the detailed elemental signals about to be received to the appropriate ones of its 64 elements.

Referring next to FIG. 28*c*, controller "B" is provided also with a series of eight row contacts as designated a to h, respectively, aligned vertically along its left side in FIG. 28*a*, and a series of column contacts numbered 1 to 8 consecutively, along the upper edge of the control. The rows and columns of elements are not shown individually in FIG. 28*c*, because of the small scale of the drawing, but it will be understood that are arranged contiguously in rows and columns so as to cover virtually the entire viewing surface of the display. This arrangement has been more particularly described in the parent application, Ser. No. 628,786 referred to above. FIG. 14 shows most of the elements that are essential to the present invention, including the rigid structural foam base 240, mentioned above, which supports the third conductor panel, or wiring board 230 on its bottom or back surface and supports the individual elements 250 which provide the visual display. These elements may be individual incandescent lamps 371, FIG. 14, supported on some base element 272, through which they are attached to board 240, or they may be more directly mounted on board 240. Electric contacts 373 which match with hollow rivit or pin-type contact elements 374 are provided. Additional details of these parts, not essential to the present invention, are shown in the parent application. Cap nuts 375 threaded onto the upwardly extending rods 215 are shown in the parent application. Cap nuts 375 threaded onto the upwardly extending rods 215, previously mentioned, may be reached from above through corner openings 379 between adjacent element faces 380, using simple tools to bolt the parts together. Except for these small corner openings, the faces of the front element cover the entire front face of the display, avoiding the gaps or blank areas that have characterized most displays of the past.

The conductor or printed side of the board 200, as seen in FIG. 28*c*, is on the back face of the panel. The eight row control elements on controller "B" are connected respectively to individual wires of a multi-wire belt or band 350. This band has a branch 305*a*, 305*b* and 350*c* for each of the three columns of modules M1. There are eight wires in each belt, or branch, to connect to individual row elements in each of the modules. This will be further explained below. Similarly, the eight column contacts, 1 to 8, inclusive on controller "B" along the top are connected by multi-wired belts 360 and branches 360*a*, 360*b* and 360*c* to the three columns in such a way as to provide a contact for each column in the module. Through these means any particular desired element of the the 64 which comprise each module may be addressed.

Now according to FIG. 29, the panel there shown is the rear wiring panel or the first printed wiring board 200. A single module area of the panel is shown in the rectangle. At eight positions corresponding to the positions of mounting elements 145, FIG. 7, there is a group of three contacts arranged around an opening 181 in this board. Collectively, these 24 contacts provide connections for all the elements on the upper or front face of the display through printed circuitry and other elements as shown in FIG. 30 which represents the reverse face of the rear panel 200.

In a large sign or display, the number of modules may run into hundreds and the number of elements into many thousands. In such cases the cost of individual wiring would be prohibitive. By the system just described the wiring is greatly simplified.

Individual wires in the belts or bands 350 and 360, are bared or contacted in each panel or module area, and contact is established through the panel 200 to connect with appropriate elements on the revese or printed side of this panel. This contact is made through specially designed staples 410 which secure a wire such as 420 to the panel 200 while holding the wire spaced from this panel, in the manner shown in FIG. AA. Here the staple 410 is shown gripping the wire, with a middle part of the staple at its right, then passing from its right side to its left, then being bent back at 411 to pass through a hole 409 in panel 200 where a shoulder 412, FIG. BB, abuts against the blank face of the board 200, while the narrower end part 413 passes through and its in-turned end is bent back to maintain a resilient (normally solderless) pressing contact against a printed element 415 on the righ face of panel or board 200. The staple mid portion is flat, the leftward bent leg parts 408 are notched out, as shown in FIGS. BB and CC to provide a wider entering notch 417 for wire 420, terminating in a narrow and sharp edged notch 418 having cutting edges 416 for cutting through the outer insulation layer on the wire so the staple contacts the metal wire. FIG. BB, shows the two sharp edges 416 which cut the insulation surrounding the wire 420 and make contact with it. Thus, electrically connecting the insulated wire 420 to the printed or conductive elements 415 on the other side of the board. This feature per se, is not novel with the present applicant, although other aspects of the staple just described are believed to be. FIG. CC shows a section in the middle of the staple, whereas FIG. BB shows a section through panel 200 with an end view of the staple. FIG. DD shows a left face view.

FIGS. EE, FF and GG show some other details of connections which are designed to function with the concept of having the panel reversible without changing polarity. These are arranged to prevent inadvertent or improper connections to wrong terminals. As will be noted in connection with FIG. 15, half of the terminals or clips 275 on the wires 272, etc., are provided with relatively narrow gaps while the other half have relatively wider gaps. The depending wires 274 in FIG. 15 are not used for connecting the buss bars to a panel such as 200 but may be used for other purposes. In some cases they may be omitted; in other cases a greater number of wires than the six shown may be needed. The clip terminals 275 are specifically sized to connect with and and only with properly mating terminals. The positive terminal 325 in the upper left corner, FIG. 29, has a connector 275 with a narrow gap and so does 328 in the lower right hand corner. The negative terminals 327 in the lower left and upper right corners of each module use the broad gapped terminals 275. It is therefore impossible, or at least impractical, to connect a negative terminal and a positive wire, or vice versa.

Details of the terminals 325, 327 are shown in FIGS. EE and GG while another simpler unflanged terminal 429 is shown in FIG. FF. Each of the former has a broader upper circular rim 422 and a reduced neck portion 423 which receives the connector 275. The broad gap negative clip 275 connects to the wider necked terminal of FIG. EE and the narrower positive clip to the narrower necked terminal, FIG. GG. Other connections are made to the unflanged terminal 429. Each of the flanged ones has a cup in its upper surface, and the heights of the bottom of cup 431 on terminal 327, FIG. EE, that of the bottom of cup 432 on terminal 325 of FIG. GG, and the height of the top of terminal 429, FIG. FF, are all exactly equal. This is done so that the outwardly or forwardly projecting pins or spacer connectors 193 of FIG. 14, see also FIG. 32, which are all of identical length, will make proper contact with their respective terminals. These are mounted on the second board or panel 210, as shown in FIG. 14. There are eight sets of three such pins 193 projecting rearwardly from the second board to make the contacts just described and there are eight sets of nine contacts 211 arranged in a circle around each control area projecting forward to make contacts with terminals 433 on the bottom or back face of the forward or front most panel 230. See FIG. 14 and FIGS. 31 and 32. In all cases, these pins or spacing connectors are formed of identical length to insure proper electrical contact.

The board 210 (controller "A") is normally a multilayer type having at least two planes of circuitry which are interconnected as required by means of well known techniques including 37 plated-thru-holes" (not shown) and the like. In any case, the pins 193 and 211 of board 210 are electrically interconnected by means of the total circuitry and/or electronic components of controller "A".

FIG. 30 shows the printed or conductive elements 415 and 414 of board or panel 200 with terminals marked "+", "R", "C", and "−", respectively, across the top. These connect with devices or terminals on the other side of the board as seen in FIG. 29, just described. Centrally in FIG. 29 there are shown four staples 410, 410*a*, 410*b*, and 410*c* arranged in a square group. Referring to FIG. 30, there are a group of contact points 441 and 442 at the left and 443 and 444 at the right, and the staples 410 and 410*b*, just mentioned, are inserted, respectively, at these two pairs of points. Thus a double electrical contact is established between wires 420 (only one is shown) on the back of the board and the conductor 415 on the front of the board which runs through points 441 and 442. A similar arrangement is made at the right where staple 410*b* makes double connections between a similar wire and the conductor 414 which extends upwardly. These double connections insure good conductivity. The upper end of a slanting conductor 445 of bar shape is connected by staple 410*a* to the lower end of a vertically extending conductor element 415*a* which also connects to terminal "R" mentioned above. The lower end of this bar element is connected by a staple 410*c*, FIG. 29, to the upper end of an analogous conductor 414*a* that runs down to the contact at the right middle center of the lower edge of panel 200.

To supply electric current to the other 16 contacts which have not been mentioned in the preceding paragraph, a group fo eight staples 410 is set into the board at the middle left and a similar group at the middle right, FIG. 30. On the opposite side of panel 200, these make electrical contact with individual wires of the belt or band 350*a* to connect these wires, respectively, with the vertical middle parts of upwardly extending conductors 415*b*, 415i c, 415*d* and 415*e* at the left of FIG. 30, and with four others that descend downward for the staples. Similarly, at the right, the band 360*a* has its individual wires connected to eight conductors on the front face, four of which extend upward and four of which extend downwardly. With these arrangements, connections are made to the terminals not specifically mentioned above. Two of these terminals, plus one terminal from another source, such as positive terminal 325 connected to the power source 320, and to controller point 337, or negative terminal 328 similarly connected to negative terminals of the same parts, or terminals "B" and "C" connected to the Controller "B", as shown in FIG. 28*b*, are arranged around each hole 181, through which a BHC 152 passes, FIG. 14. Through these connections, to 24 pins 193, connections are made to the second panel or wiring board 210. In some cases, it may not be practical to use staples in the webs or bands 350 or 360. In such instances, it may be necessary to cut the insulation away from individual wires and use a supplemental means with the staple to carry the current through the board, as will be obvious.

The arrangement of terminals and conductors on each panel or module area M1, as just described, is symmetrical so that the panel can be inverted without interfering with proper electrical connections, as previously mentioned. Likewise the wiring and conductor arrangement on the front board or panel is symmetrical and reversible. This will next be described.

Panel 230, or printed wiring board #3, is the front distributing panel and is connected directly to the frontal exposed elements 250 which make up the surface of the display or radiation giving or receiving surface. On its rear surface it bears eight groups of terminals, 433 nine in each group, one of which is seen in FIG. 14. Each of these is connected through the board to a front surface network or printed circuitry for each module or module area of the assembly. Thus there are 72 points of contact to supply current connections to 64 discrete elements, 250 plus 8 ground wire returns which are common to eight elements each.

Figure 31:
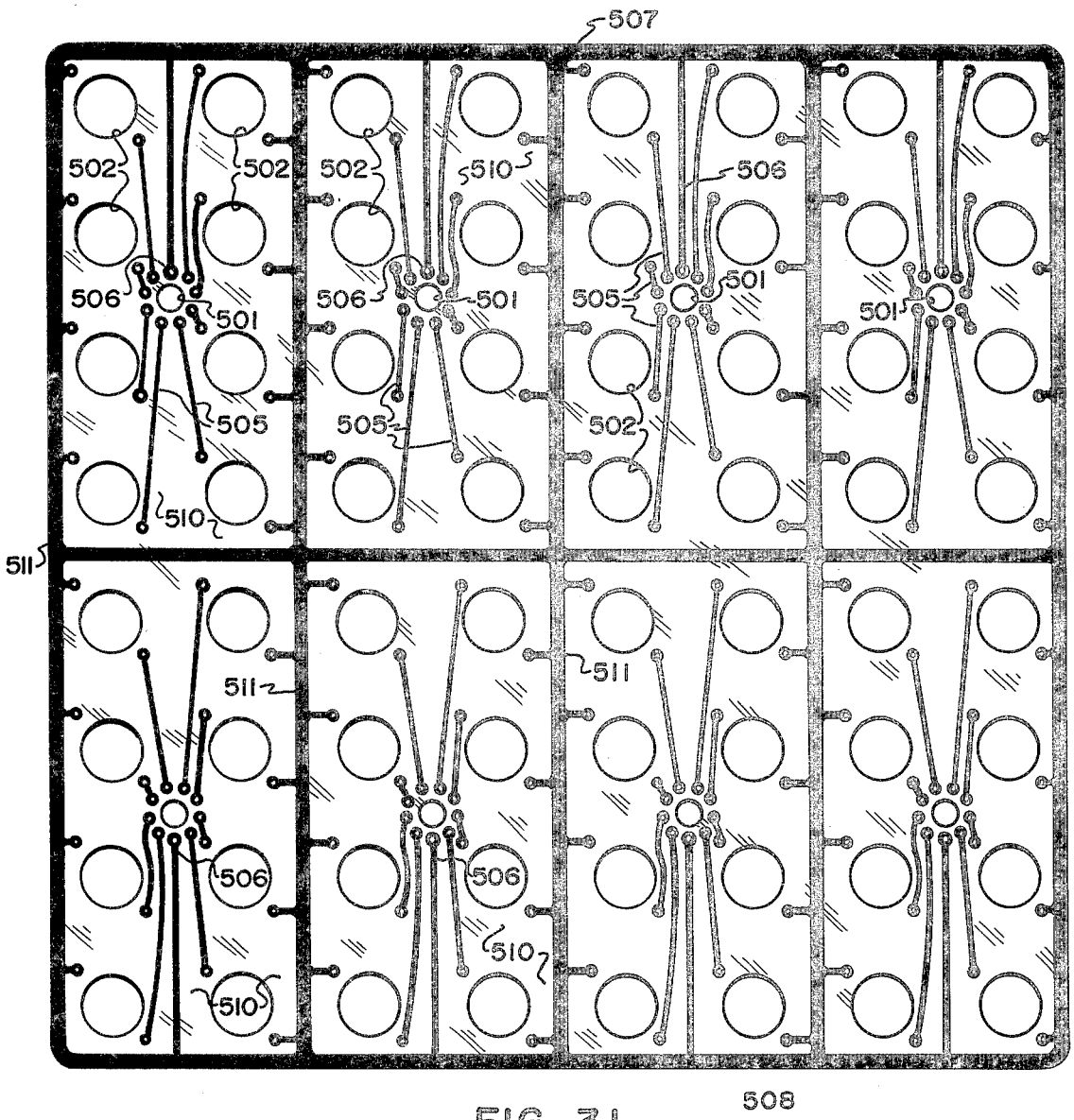
FIG. 31 is a bottom face view of the printed wiring of board 230; a partial side sectional view of the latter being shown in FIG. 14.

As shown in FIG. 31, an element area or site is provided for each of the 64 elements, these being shown as circles 502. From the contacts 433 which in turn are connected with the pins 211 mentioned above, respectively, conductive elements 505 on the front of the panel 230 radiate from each group to eight sites where the elements 250 are mounted. The specific details of such mounting are not a part of the present invention, being described in detail in the parent co-pending application, Ser. No. 628,786 referred to above. Some details, shown in FIG. 14, have been given above. Eight of the conductors 505 extend individually to an element site from the circle of contacts seen surrounding an opening 501, FIG. 31, in the center of each group of eight elements. This opening is aligned with opening 212 in the second panel 210 and opening 181 in the rear or first panel 200, as shown in FIG. 14. The ninth conductor 506 of each group extends to an upper or a lower ground wire, 507 or 508 extending along the upper and lower edges, respectively, of the panel area. Ground return terminals 509 connect to one or another of vertical ground wires or bars 511. These also are connected to upper and lower conductors 507 and 508 and, in turn to appropriate return terminals in the panel 200, through the bottom contacts 433 and the pins or spacer connectors 211.

Figure 32:
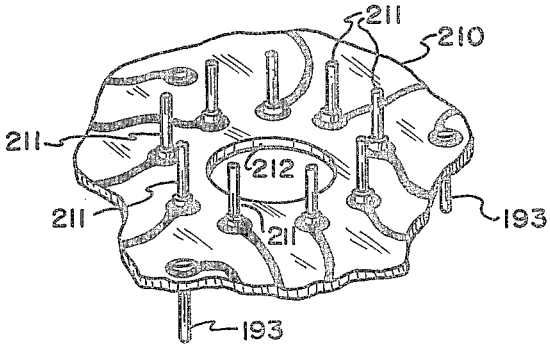
FIG. 32 is a fragmentary perspective portion of the Controller "A" printed circuit board 210; a side sectional view of which is also shown in FIG. 14.

A group of the pins 211 are shown projecting upwardly or forwardly from a part of an intermediate panel 210 in FIG. 32. Projecting to the rear towards rear panel 200 are shown two of the pins 193 but it will be recalled that there are a total of 24 of the pins 193 and 72 pins 211 for each module panel or module area. Opening 212 is shown in the center of the group of pins, aligning in the assembled structure with openings 181 in panel 200 and 501 in the front panel, FIG. 31, as noted above. The group of pin connectors shown in FIG. 32 constitutes a sort of controller, designated "Controller A". It will be recalled also that the second panel or printed board 210 has control functions and is provided with electronic parts 601, FIG. 14, for this purpose. The specific types and arrangements of these parts is not a part of the present invention and no further description needs to be given herein as they are known in many forms and arrangements and are well understood in the art.

From the above description, it will be seen that electrical connections to (or from) a central power source (or receiver) 420 to ultimate exposed elements 250, such as lamps, movable elements presenting faces having different color, or other radiating characteristics, or elements designed to receive radiant energy and convert it to usable electric power, etc., are made individually and selectively through the various means which have been illustrated and described in detail. Through conductors 321 and 322 the power source or receiver 320 is connected to buss bars 180 which distribute current to the center of each module area and through connectors 600 as in FIG. 15 to multiple points in each module. By means of signals from Controller "B", and other parts which cooperate with it, individual modules are activated or enabled so that when signals are provided for discrete and selected elements 250, they will not be blocked. Such signals, coming in part from the Controller "B", with its module row and column control functions and its more specific element row and columns, plus control signals received in or modified or produced within the "smart" electronics of the middle panel 210, are transmitted to the individual elements through the wiring panels 200 and 230, with the intermediary connectors 193 and 211 serving to take the current from panel to panel.

In the claims which follow, certain terminology may be used in abnormal senses and some definition of terms is in order. By "Information Display" it is intended to refer to a system wherein radiating, visual or other sensible symbols are produced over an exposed surface area by selectively activating particular elements in the surface area to differentiate them from other elements. These elements may be or comprise incandescent lights, movable parts which have differently colored surfaces or parts with different energy radiating or receiving properties. When not limited to "Information", the "Display" may also comprise an arrangement of multiple radiant energy receiving or transmitting elements wherein radiant energy from a natural body, such as heat from the sun, is received and converted to usable energy. In this case, the selective activation of the elements may not be necessary but the same circuitry, aside from selectivity, will be involved. Terms such as "radiation sensitive" will be construed broadly enough to cover both the radiation or the transmission of light, including changes in color and the like as well as actual receipt and conversion of sunlight or heat to electrical energy, unless the context requires a narrower construction. A control region or function will be understood to refer, in the broadest sense, to means, panels, circuitry, etc., which can either select and activate discrete elements or can transmit signals, currents or electric power in either direction with or without limiting it to particular modules, module areas, subareas on modules, or ultimate exposed elements at the major surface where information is being displayed or energy gathered, etc.

It is also to be understood that the recitation of parts or functions as being "adjacent" to or "connected with" particular units or functions need not necessarily imply that the parts are in physical proximity, or directly adjacent, contiguous, intermediate or tied in with other parts. Units such as Controller "B" and other parts may in fact be at some remote location and the power source or power receiver likewise. On the other hand, there are real advantages in having the various panels in close proximity and preferably in parallel planes, concentric surfaces, etc., so that multiple connections can be made with small, similar and simple parts, such as the pins 193, 211, BHC connectors 172 and 152, buss bars 180 and the wiring assemblies 600 and other simplified parts. In fact, an important advantage of the present invention resides in the fact that the number of connectors, wires or the like needed to control individually many hundreds or thousands of front elements in a large display or large surface radiant energy conversion system, is reduced many fold over conventional systems.

It will be understood also that many modifications and variations of the specific parts, modules, connections and other physical structures may be made within the proper scope of the invention by those skilled in the art without departing from the spirit and purpose of this invention. In the claims which follow, it is intended to cover the essential and distinguishing characteristics of this invention as broadly as the state of the art properly permits.

What is claimed is:

1. Apparatus for presenting and controlling a large number of individual radiatively functional elements over a large display area and for ultimately connecting each and all of said elements with a main central area control station comprising, in combination:

(a) a supporting base behind and generally coextensive with the display area, said main station being associated with said base, (b) a plurality of separate individual module support members supported by said base in rows and columns for holding the elements in the display area in module groups and in contiguous rows and columns, each of said separate module support members including separate sub-area means for holding a plurality of small sub-groups of said elements in respective module sub-areas, (c) front panel means located between the modular support members and the functional elements and including sub-groups of electrical connectors for establishing electrical contact between each individual element in the sub-group and a central sub-group control point, said sub-group control points being symmetrically arranged behind the elements which constitute the module area, (d) further panel means arranged between the front panel means and the respective module support members and including electrical connectors between each of the sub-group control points and a central module control point, and (e) means connecting each of said central module points to the main control station.

2. Apparatus according to claim 1 in which there are individual electrical connections one way between said elements and said local points with return connections grouped into a single conductor.

3. Apparatus according to claim 2 in which the return connections are grouped over a complete module area.

4. Apparatus according to claim 1 which includes a base member for supporting a module group of elements provided with multiple support elements distributed symmetrically to constitute said local points and a central lockable holding means in the center of said base member to support buss bars as electrical distributors along a plurality of aligned module areas.

5. Apparatus according to claim 4 in which the buss bars are mounted in closed loops of bifurcate flexible support posts, the bifurcate legs of said posts being locked into said central holding means.

6. Apparatus according to claim 4 in which electrical contact means for a said buss bar are mounted within the closed loop of the support post in the center of each module area.

7. Apparatus according to claim 1 which includes a third panel mounted between said first and second panels.

8. Apparatus according to claim 7 in which said third panel includes local electronic circuitry for controlling selective activation of said sensitive elements over each module.

9. Apparatus according to claim 1 which includes a support post located at each sub module control point and contact means grouped around each support post for conveying current between said first and second panels.

10. Apparatus according to claim 9 in which each local support post consists of a flexible loop end bifurcate member and a cross bar element engaged by said loop end.

11. Apparatus according to claim 1 which comprises a third panel means between said first and second panel means, said thrid panel means comprising selective electronic control means for activating selective ones of said independent elements over plural sub-module areas, and buss bars supported on one of said panels for distributing electric current to an aligned group of module areas.

12. Apparatus according to claim 11 in which each buss bar comprises a half bar with an insulation layer between said half bars and an outer penetrable insulation layer surrounding and enclosing said half bars and the insulation layer between.

13. Apparatus according to claim 12 which includes penetrating electrically conductive contact elements adapted to be forced through said outer insulation layer to make electrical contact with said half bars.

14. Apparatus according to claim 13 in which a penetrating element for each module area is connected to multiple points in said module area for ultimate connection to the individual display surface elements.

15. Apparatus according to claim 13 in which the penetrating elements and conductor parts attached thereto are encased in symmetric and interchangeable insulator housings mounted within loops of bifurcate posts which support said buss bars at the center of each module area.

16. Apparatus according to claim 1 in which a molded insulating tile base is provided for supporting electrical components over each module area.

17. Apparatus according to claim 1 in which individual support bars for each local support point are mounted on a basic support for the entire display system.

18. Apparatus according to claim 17 wherein each base comprises a cross bar which engages the loop part of a bifurcate post which, in turn, supports at least one of the panel means at a local support point.

* * * * *